US008459410B2

(12) United States Patent
Parvizian et al.

(10) Patent No.: US 8,459,410 B2
(45) Date of Patent: Jun. 11, 2013

(54) SYSTEM AND METHOD FOR A MODULAR STEP STOOL

(75) Inventors: Goli Parvizian, McLean, VA (US); Ken Sowers, Walkersville, MD (US)

(73) Assignee: Kinder Pal, LLC, McLean, VA (US)

( * ) Notice: Subject to any disclaimer, the term of this patent is extended or adjusted under 35 U.S.C. 154(b) by 731 days.

(21) Appl. No.: 12/607,988

(22) Filed: Oct. 28, 2009

(65) Prior Publication Data

US 2011/0061972 A1 Mar. 17, 2011

Related U.S. Application Data

(60) Provisional application No. 61/241,570, filed on Sep. 11, 2009.

(51) Int. Cl.
*E06C 1/00* (2006.01)
*A63H 33/08* (2006.01)

(52) U.S. Cl.
USPC ..... 182/35; 446/117; 446/128; 182/178.5

(58) Field of Classification Search
USPC ..... 182/33, 35; 446/117, 128
See application file for complete search history.

(56) References Cited

U.S. PATENT DOCUMENTS 3,305,982 A * 2/1967 Steele ..... 52/90.1
4,253,268 A 3/1981 Mayr
4,919,635 A * 4/1990 Bertrand ..... 446/128
4,992,069 A * 2/1991 Bolli et al. ..... 446/128
5,078,354 A * 1/1992 Kim ..... 52/562
5,651,753 A * 7/1997 Wilkinson ..... 482/52
5,653,621 A * 8/1997 Yao ..... 446/127
5,661,941 A * 9/1997 Vataker ..... 52/604
5,772,559 A * 6/1998 Sithole ..... 482/52
5,848,927 A * 12/1998 Frederiksen ..... 446/128
5,853,314 A * 12/1998 Bora ..... 446/120
5,938,497 A * 8/1999 Mott ..... 446/122
6,050,044 A * 4/2000 McIntosh ..... 52/591.1
6,142,847 A 11/2000 Rudy
6,200,187 B1 * 3/2001 Olsen et al. ..... 446/122
6,250,986 B1 6/2001 Sorensen
6,447,360 B1 9/2002 Sorensen
6,511,073 B2 * 1/2003 Simonds ..... 273/299
6,554,676 B1 4/2003 Bach (Continued)

OTHER PUBLICATIONS

RV Leveling Blocks—Set of 4; http://www.campingworld.com/shopping/item/rv-leveling-blocks-set-of-4/24732, Feb. 27, 2009.

*Primary Examiner* — Katherine Mitchell
*Assistant Examiner* — Candace L Bradford
(74) *Attorney, Agent, or Firm* — Doster Greene, LLC

(57) ABSTRACT

A modular step stool system according to various embodiments can include a plurality of stepping blocks comprising a first stepping block and a second stepping block configured to support a user's body weight. A plurality of interlocking elements is interposed between the first stepping block and the second stepping block for horizontally and vertically interconnecting and interlocking at least the first and second stepping blocks to form a raised step platform. Some of the plurality of interlocking elements include sub-couplings which are configured to provide simultaneous horizontal and vertical interconnections. Some embodiments of the device include raised walls configured within the side walls and corner tabs inserted within the corners of the stepping blocks and configured having a profiled selected based upon the shape of the sub-couplings to facilitate stacking and interconnections in at least one of a horizontal, a vertical, a perpendicular, and an offset configuration.

23 Claims, 18 Drawing Sheets

U.S. PATENT DOCUMENTS

| | | | | |
|---|---|---|---|---|
| 6,616,499 | B1 | 9/2003 | Sorensen | |
| 6,645,033 | B1 * | 11/2003 | Thomsen | 446/120 |
| 6,648,715 | B2 * | 11/2003 | Wiens et al. | 446/121 |
| D536,392 | S * | 2/2007 | Van Ness | D21/386 |
| 7,231,740 | B2 | 6/2007 | Jirele | |
| D546,401 | S * | 7/2007 | Sorensen | D21/484 |
| 8,105,128 | B1 * | 1/2012 | Sorensen et al. | 446/128 |
| 2004/0116037 | A1 * | 6/2004 | Garpow | 446/74 |
| 2008/0166926 | A1 * | 7/2008 | Seymour et al. | 439/701 |
| 2008/0220690 | A1 * | 9/2008 | Munch | 446/128 |
| 2009/0124464 | A1 * | 5/2009 | Kastelic | 482/52 |

* cited by examiner

SYSTEM AND METHOD FOR A MODULAR STEP STOOL

REFERENCE TO RELATED APPLICATION

This application claims priority of U.S. Provisional Patent Application Ser. No. 61/241,570, which was filed on Sep. 11, 2009. The subject matter of the earlier filed application is hereby incorporated by reference.

FIELD

The present teachings relate to devices and methods using a modular step stool system of stepping blocks that can be rearranged in several ways to form a variety of different configurations to offer safety and security for use by a toddler or young child with various bathroom fixtures, such as a toilet, a sink, and a tub.

INTRODUCTION

Transitioning from diapers to learning to successfully use an adult toilet is an important stage of development for every toddler. However, the learning process can present several challenges for such a young individual and the adult caregiver. Teaching a toddler to use an adult toilet requires that the toddler feels secure and comfortable during the toilet training process.

Toddlers are more likely to successfully accomplish toilet training if they feel more secure about using the toilet and are able to maneuver themselves on and off the toilet easily any time they need to go and to stabilize themselves with their feet to push when they have a bowel movement. However, a toddler's size in comparison to an adult toilet may hinder the toddler's progress in using the toilet. The age and size of a toddler when an adult caregiver may begin the toilet training process may vary and depend upon many factors. Some adults prefer to have a toddler successfully toilet trained before the toddler reaches the age of one. While on the other hand, other toddlers may not be prepared to learn to use a toilet well into their fourth year. Regardless when toilet training is undertaken during the toddler stage, a toddler may feel overwhelmed and intimidated by the size of the adult toilet. For instance, while sitting on the adult toilet, the toddler may experience discomfort or insecurity due to the toddler's short legs which tend not to reach the floor and dangle unsupported. Thus, the toddler's legs are not stabilized and cannot aid the toddler with pushing to facilitate the toddler's bowel movement. Therefore, the toddler oftentimes will sit unsuccessfully upon the toilet for an extended time without having a bowel movement, which discourages the toddler and hinders his or her progress.

Another disadvantage associated with the toddler's size and height, especially for a male toddler, is obtaining control over the direction of his urine flow. The toddler will most likely encounter occasions when there are mishaps and misdirects his urine wetting the exterior or base of the toilet and the surrounding floor area. If the soiled items and areas are not cleaned and sanitized immediately or if these areas are frequently soiled during the toilet training process, a foul odor may eventually develop. Such mishaps can be attributed to the toddler's inexperience and his incorrect positioning due to his limited height in comparison to the adult toilet.

Numerous urinal mats and toilet training devices exist. In some cases, these devices are configured as flat mats that collect and chemically treat the spilled urine, but do not vertically adjust according to a toddler's size to facilitate toilet training. In some cases, the height of these toilet training devices can be adjustable, but these devices are bulky mechanical devices that physically attach to the toilet.

In addition to learning to use an adult toilet, a toddler may also be overwhelmed by the size of other adult bathroom fixtures, such as, a sink and a bathtub. Thus, the toddler may also need a step stool to use such facilities. Similar to the potty training device, such a step stool should provide the toddler with security and comfort during use. Therefore, a caregiver may be required to purchase several different devices to assist a toddler to use several different bathroom fixtures within a single bathroom. The storage of these different devices can be cumbersome and untidy.

Furthermore, some toddler potty training devices and step stools are advertised as multipurpose devices allegedly having a wide application with several different bathroom fixtures. Oftentimes, such devices may be appropriate for a particular use with a specific bathroom fixture, but inappropriate for another use with another bathroom fixture because the device fails to provide the toddler with security and safety when using the other bathroom fixture. For example, some miniature potty training devices are advertised as being adjustable from a potty seat to a step stool. Such a device may be converted from a potty seat to the step stool by closing the lid so that the lid serves as a standing surface of the step stool. However, oftentimes when the toddler uses the device as a step stool, for example, with a sink to assist the toddler with washing his or her hands, the device may be unstable, wobble, shift or slide as the toddler steps upon, stands on and/or exits from the device. Furthermore, in some cases, when the potty seat is converted to a step stool, the standing surface is inadequate and too small to permit the toddlers to comfortably stand upon and maneuver themselves during use. Although the caregiver is aware of these shortcomings of the device, the caregiver may reluctantly settle for using one device designed for a certain bathroom fixture that is inappropriate or unsafe for use with another bathroom fixture, because the caregiver is unable to find a more suitable multipurpose device.

It may be desirable to provide a modular step stool system as a supporting surface that offers security and comfort to a toddler during toilet training. It may also be desirable to assist a male toddler with properly orientating himself with respect to the toilet according to the size of the toddler. It may also be desirable to provide a supporting surface for assisting a toddler with toilet training, so as to avoid the use of mechanical equipment to physically attach the device to an adult bathroom fixture. It may also be desirable to provide a supporting surface that can be easily rearranged to accommodate various bathroom fixtures. It may also be desirable to provide a supporting surface that is relatively simple in terms of design and implementation.

SUMMARY

The present invention may satisfy one or more of the above-mentioned desirable features. Other features and/or advantages may become apparent from the description which follows.

A system according to various exemplary embodiments can include a plurality of stepping blocks comprising a first stepping block and a second stepping block. The first stepping block may include a plurality of male connectors that extends outward from a side wall at a top surface of the first stepping block, wherein at least some of the plurality of male connectors include a raised sub-coupling stud to facilitate connecting some of the plurality of blocks together vertically. The second stepping block may include a plurality of female connectors for receiving the plurality of male connectors therein to connect the first and second stepping blocks horizontally to form a step platform and to prevent horizontal displacement of the first and second stepping blocks when connected together horizontally.

A system according to various exemplary embodiments can include a first stepping block and a second stepping block. The first stepping block can include a first stepping surface containing a plurality of coupling studs, wherein at least some of the plurality of coupling studs have differing configurations. The second stepping block can include a second stepping surface and a plurality of side walls extending from a top surface to define a cavity within a bottom surface, wherein the cavity is partitioned into a plurality of sub-cavities that define a plurality of hypocycloids for receiving the plurality of coupling studs to vertically interconnect the second stepping block onto the first stepping block to form a raised step platform.

A modular step stool system according to various embodiments can include a plurality of stepping blocks comprising a first stepping block and a second stepping block configured to support a user's body weight. A plurality of interlocking elements is interposed between the first stepping block and the second stepping block for horizontally and vertically interconnecting and interlocking at least the first and second stepping blocks to form a raised step platform. Some of the plurality of interlocking elements include sub-couplings which are configured to provide simultaneous horizontal and vertical interconnections.

A method of converting a modular step stool system to another article of furniture according to various exemplary embodiments can include providing a plurality of stepping blocks comprising a first stepping block, a second stepping block, and a third stepping block; wherein each of the plurality of stepping blocks includes a modular construction; interconnecting the first, the second and the third stepping blocks using a plurality of interlocking elements interposed between the plurality of stepping blocks to form a raised step platform; horizontally interconnecting the first and second stepping blocks, wherein the first stepping block includes a plurality of male connectors and the second stepping block includes a plurality of female connectors for receiving the plurality of male connectors; vertically interconnecting the third stepping blocks with the first and second stepping blocks, wherein at least one of the first and second stepping blocks include a top surface containing a plurality of coupling studs to facilitate connecting the plurality of blocks together vertically and wherein the third stepping block includes a plurality of side walls extending from a top surface of the third stepping block to define a cavity within a bottom surface, wherein the cavity is partitioned into a plurality of sub-cavities that define a plurality of hypocycloids for receiving the plurality of coupling studs to vertically connect with at least one of the first and second stepping blocks; providing some of the plurality of interlocking elements configured to provide simultaneous horizontal and vertical interconnections; and converting the plurality of stepping blocks of the raised step platform to form at least one other article of furniture.

In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

BRIEF DESCRIPTION OF THE DRAWINGS

The skilled artisan will understand that the drawings described below are for illustrative purposes only. The drawings are not intended to limit the scope of the present teachings in any way.

DETAILED DESCRIPTION OF VARIOUS EMBODIMENTS

Figure 1:
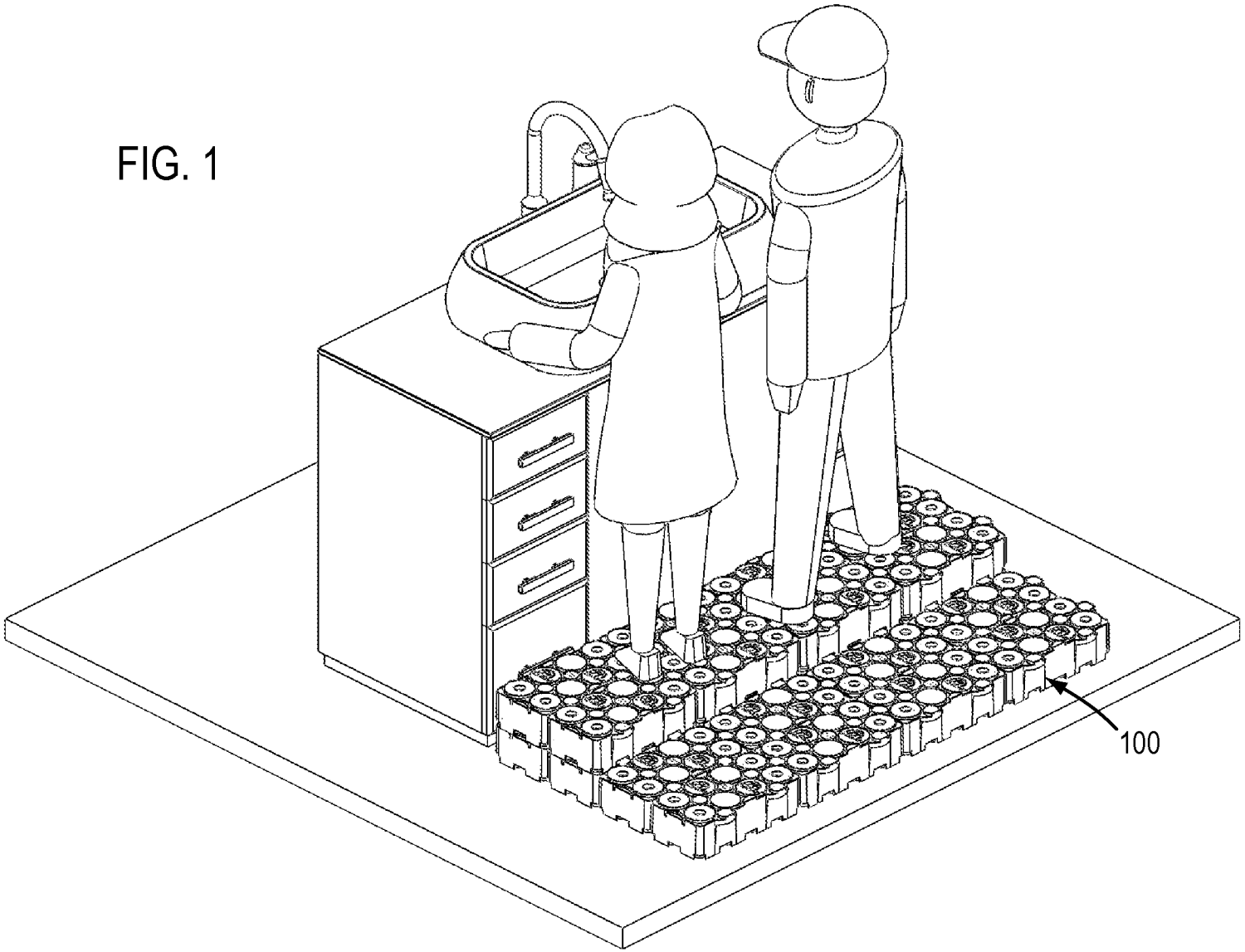
FIGS. 1 to 4 are perspective views of a modular step stool system in accordance with the present teachings.

Reference will now be made to various embodiments, examples of which are illustrated in the accompanying drawings. However, these various exemplary embodiments are not intended to limit the disclosure. On the contrary, the disclosure is intended to cover alternatives, modifications, and equivalents.

Throughout the application, description of various embodiments may use "comprising" language, however, it will be understood by one of skill in the art, that in some specific instances, an embodiment can alternatively be described using the language "consisting essentially of" or "consisting of."

For purposes of better understanding the present teachings and in no way limiting the scope of the teachings, it will be clear to one of skill in the art that the use of the singular includes the plural unless specifically stated otherwise. Therefore, the terms "a," "an" and "at least one" are used interchangeably in this application.

Unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained. In some instances, "about" can be understood to mean a given value±5%. At the very least, each numerical parameter should at least be construed in light of the number of reported significant digits and by applying ordinary rounding techniques.

Various embodiments provide a toddler with a compact and portable supporting surface that is readily assembled and dissembled by the toddler's caregiver. In various embodiments, the supporting surface may be easily dissembled and stored in a compartment, such as, for example, a suitcase, for easily transporting the supporting surface during travel with a toddler for use, for example, in hotels or on family vacations.

Various embodiments provide a toddler with a modular step stool system that can be configured as a vertically adjustable platform including a plurality of stepping blocks that securely interlock one with another to form a supporting surface. In various embodiments, the platform also firmly affixes to the floor or the underlying surface to prevent movement during use. Thus, the device offers a toddler security, comfort and reassurance during toilet training. Various embodiments assist a male toddler with properly orienting himself with respect to the toilet according to the size of the toddler by providing an adjustable platform that is suitable for the toddler to step upon and adjust his height relative to the toilet to facilitate control over the direction of his urine flow.

Various embodiments of the modular step stool system described herein enable toilet training without the addition of complicated mechanical devices attached to an adult toilet, making such embodiments particularly suitable for transportable applications because the device is relatively compact and light weight. In some embodiments, the device can be transported fully or partially assembled as a platform or the device can be easily and quickly disassembled and reassembled to form the platform. In various embodiments, the operation of the device may be relatively simple and robust, and may enable toilet training without external mechanical devices or equipment attached to the toilet to adjust the toddler's height.

In various embodiments, accommodation of a wide variety of different shaped bathroom fixtures may be accomplished using substantially the same device since virtually unlimited numbers of shapes of the interchangeable stepping blocks can be designed and used to meet the specific base of a particular bathroom fixture. For example, various embodiments of the device can be used by a toddler across a wide range of bathroom fixtures, such as a base of a toilet, a base of a sink or a base of a bathtub to adjust the height of the toddler during use of such bathroom fixtures.

Figure 2:
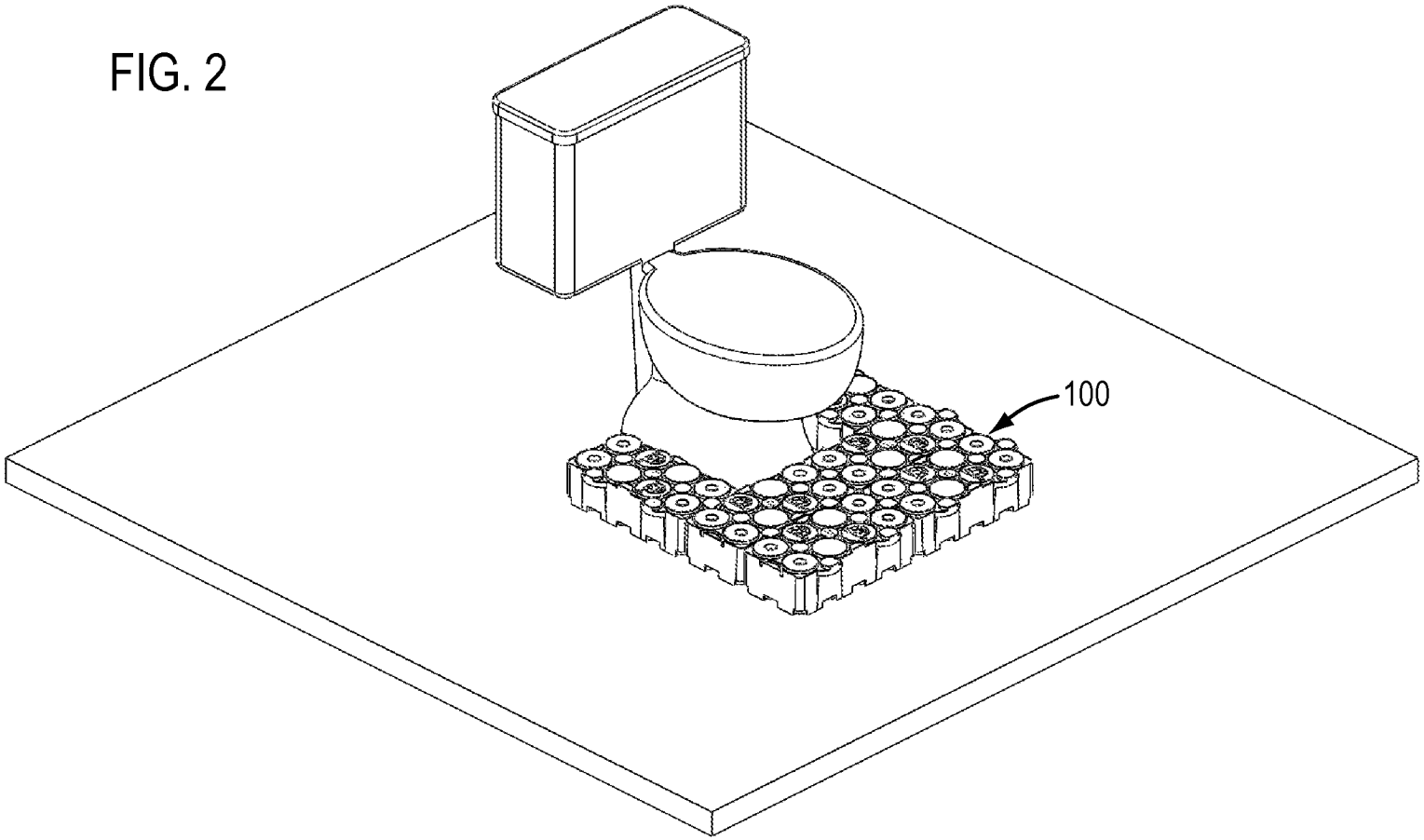
Figure 3:
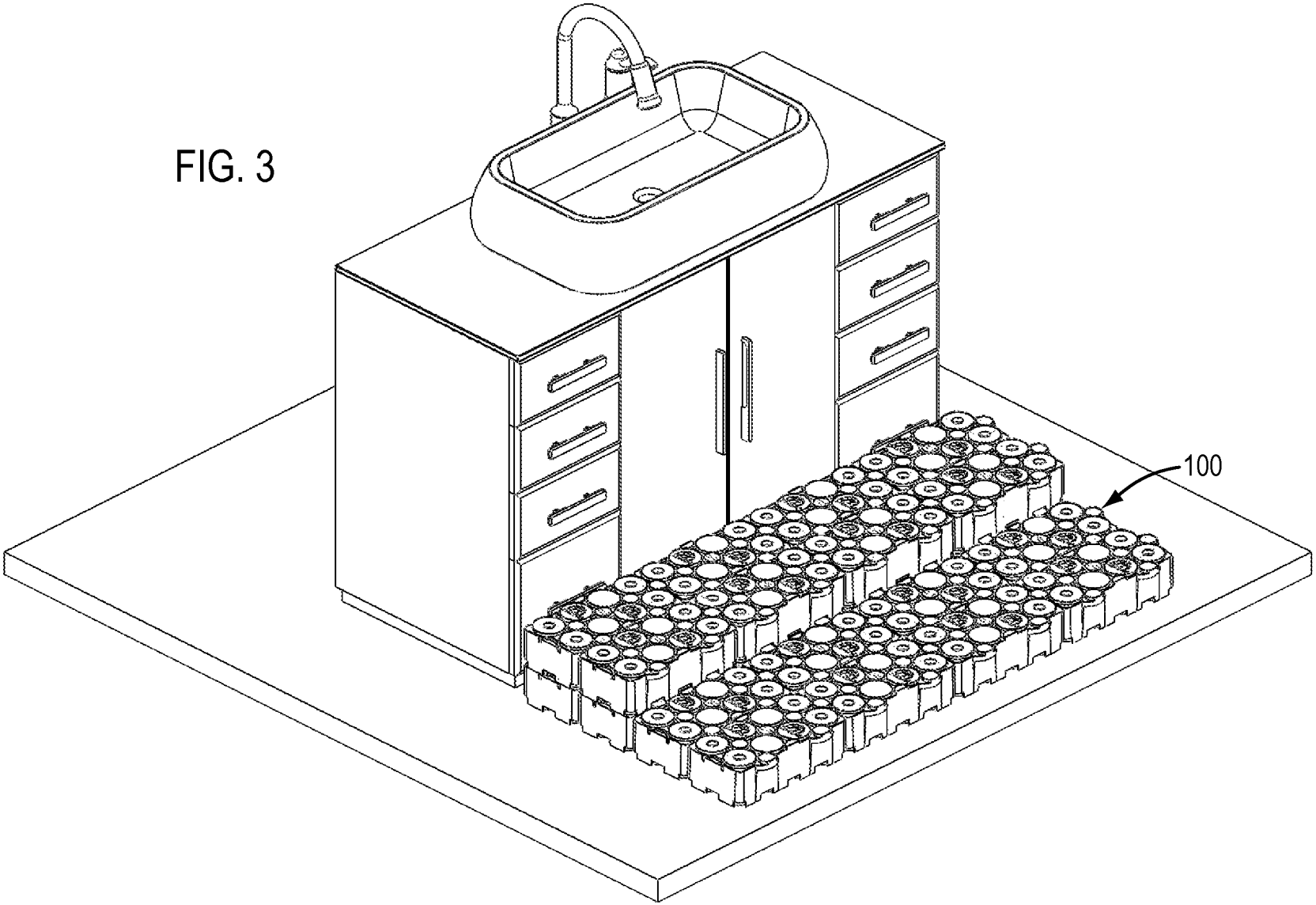
Figure 4:
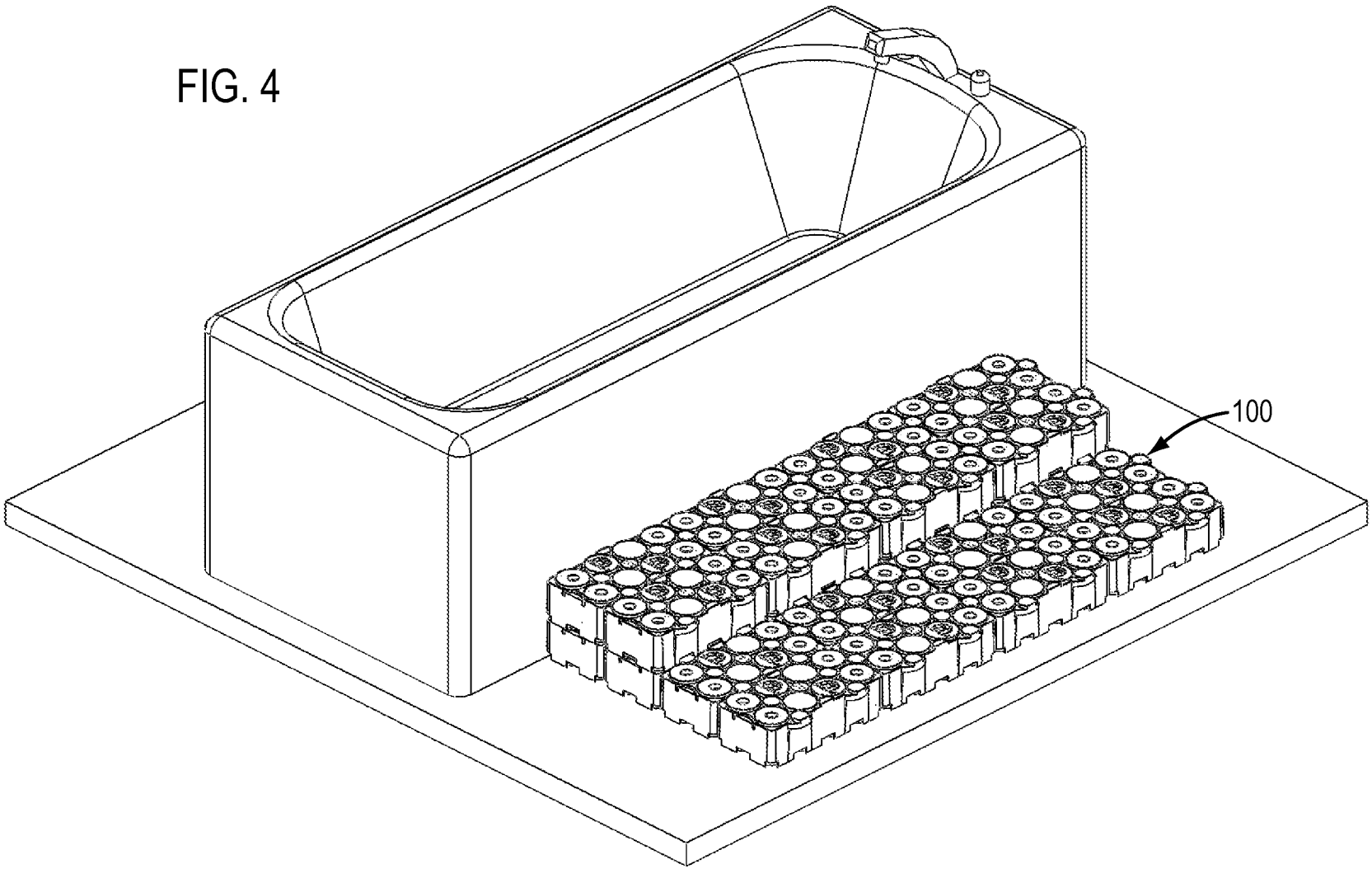

FIGS. 1-4 illustrate exemplary embodiments of a modular step stool system 100 of stepping blocks that can be rearranged in several ways to form a variety of different configurations to offer safety and security for use by a toddler or young child with various bathroom fixtures, such as a toilet (FIG. 2), a sink (FIG. 3), and a tub (FIG. 4). The stepping blocks of the modular step stool system are versatile and interconnectable so that they can be converted to provide a wider surface area for greater stability than conventional step stools. The device can be configured to simultaneously accommodate one, two, or possibly three children during use, for example, as shown in FIG. 1. The device can also be used as a bench or kneeler to assist parents or caregivers during bathing. The stepping blocks can be configured to support the sitting weight of an adult and can be stacked to accommodate each user's height to provide comfort while sitting. Structural features are strategically designed within interlocking elements of the device such that it is strong and sturdy, yet lightweight. Some of the interlocking elements are configured such that they are capable of providing simultaneous horizontal and vertical interconnections.

Various interlocking elements may be provided to stack and secure one stepping block 300 on top of another stepping block 300, in a stacked configuration shown as a raised platform in FIGS. 1, 3, and 4. FIGS. 5-10 illustrate a first embodiment of the stepping blocks 300. Each stepping block 300 can include a substantially rigid top surface 305 that provides a standing surface and a plurality of side walls 310 that extend from the top surface 305 which define a cavity 700 (FIG. 9) located at a bottom surface 315. The top surface 305 may have a plurality of projections integrally projecting therefrom. The projections of one stepping block may be aligned and mated with openings provided in another stepping block to define interlocking elements so that at least two of the stepping blocks can be interlocked and stacked one atop of the other to form a raised step, platform or bench (FIGS. 1, 3 and 4). In this locked state the stepping blocks are latched and secured to each other to prevent shifting during use by the user. The stepping blocks can be connected and interlocked vertically, horizontally, and perpendicularly to each other, as shown, for example in FIGS. 1-4 and 20-24.

In various embodiments, the interlocking elements may be strategically positioned as projections and openings formed or attached at various locations of the modular step stool device. In addition to having an opening-and-projection interlocking element, the modular step stool device may include additional interlocking element, such as a hook and loop fastener, for example, Velcro™ to assist with stacking and connecting the stepping blocks together. Those having skill in the art would recognize various additional interlocking elements and/or configurations that may be used to assist with stacking and securely locking at least two of the stepping blocks while providing a flat and secure surface for a user.

Figure 5:
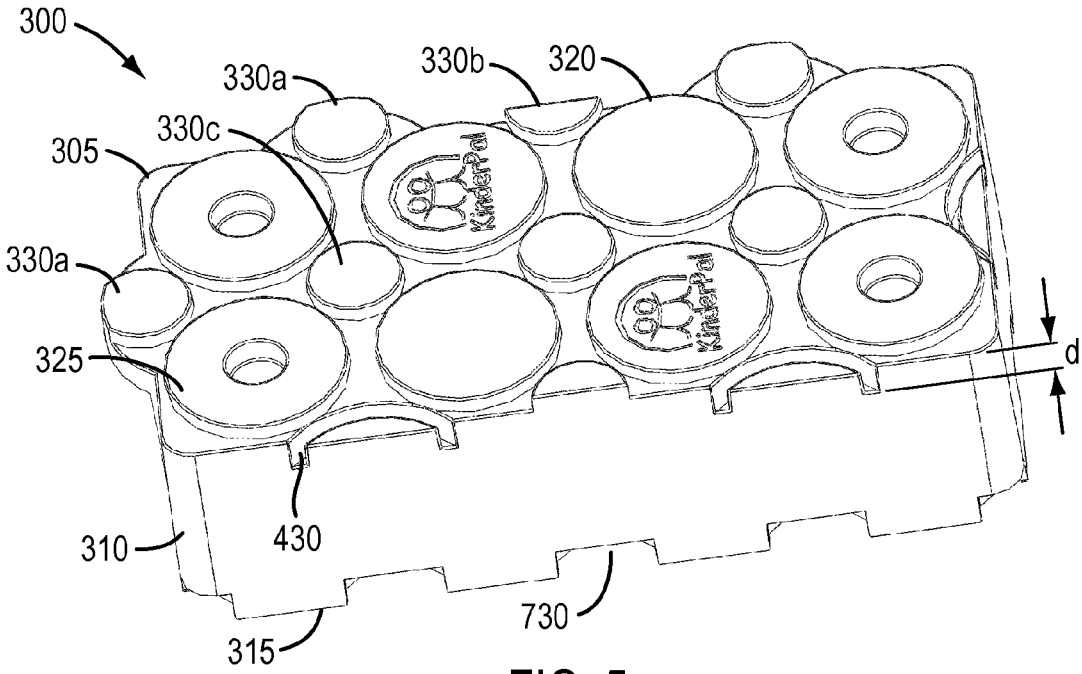
FIGS. 5 and 6 are perspective views of an exemplary embodiment of a stepping block in accordance with the present teachings.
Figure 10:
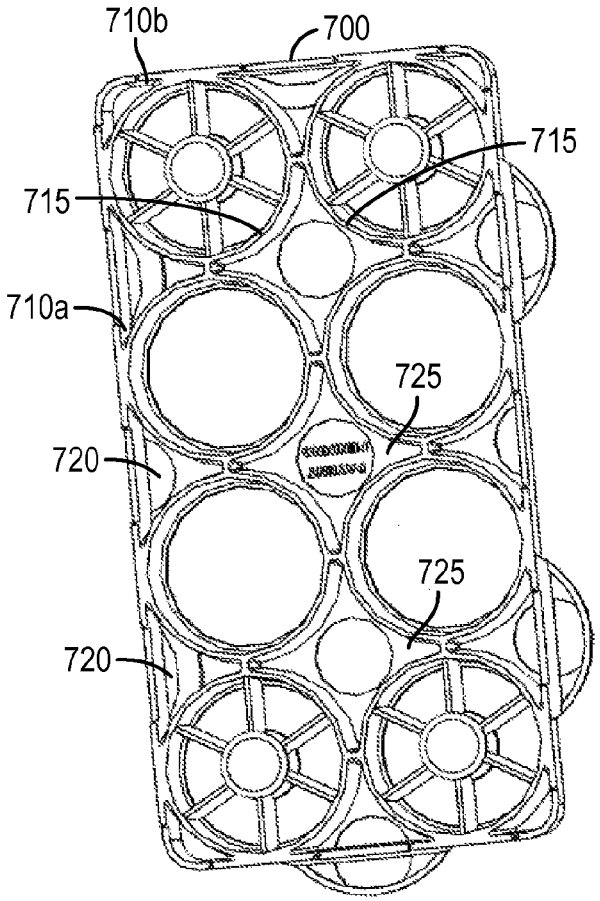
FIG. 10 is a bottom view of the stepping block of FIGS. 5 and 6.
Figure 11:
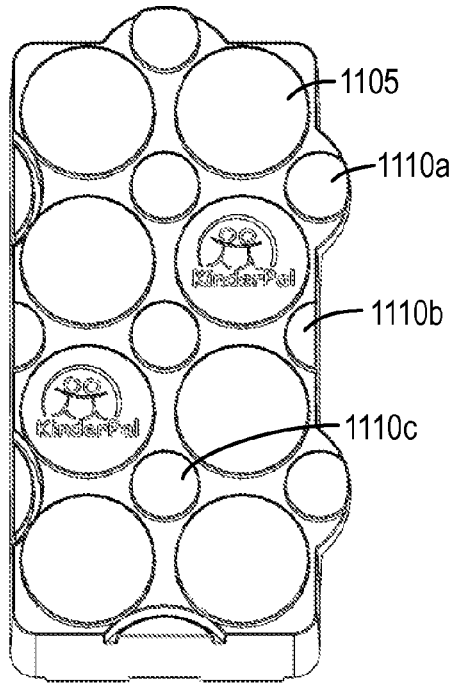
FIG. 11 is a top view of another exemplary embodiment of a stepping block according to the present teachings.
Figure 14:
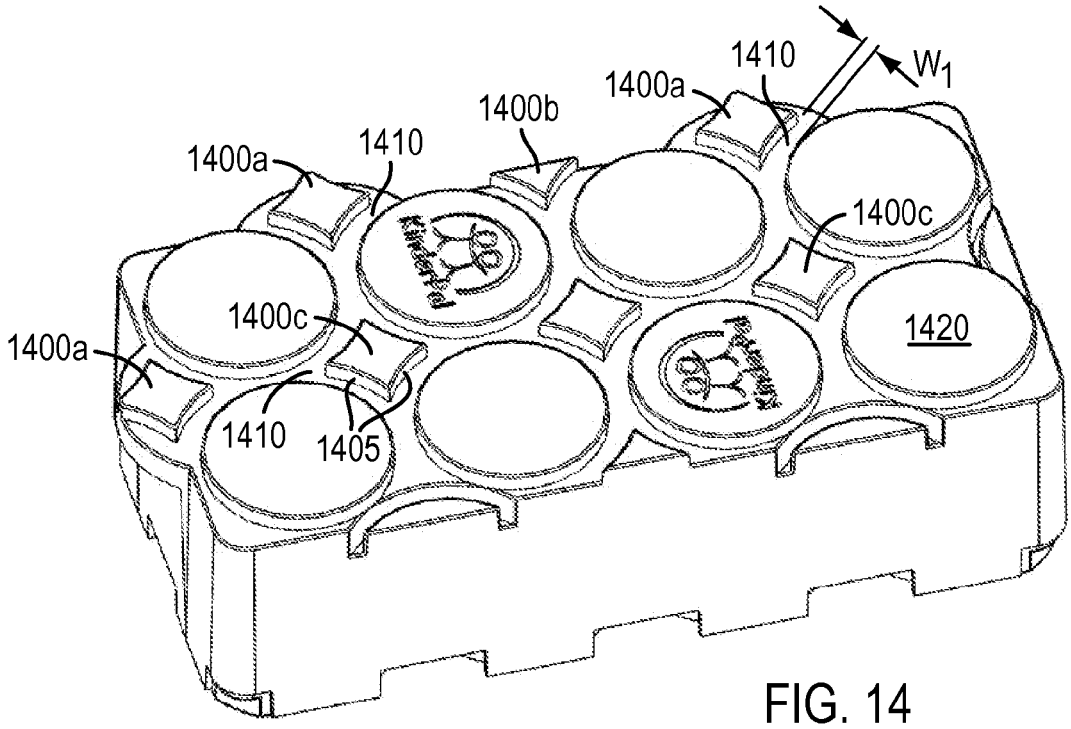
FIG. 14 is a perspective view of yet another exemplary embodiment of a stepping block according to the present teachings.

Examples of the interlocking elements that can be employed in the present teachings of the modular step stool device 100 are illustrated in the embodiments of FIGS. 5, 11, and 14. In FIG. 5, the top surface 305 may have a plurality of coupling studs that are raised above its generally planar surface that functions as projections. The coupling studs can be used to connect frictionally the top surface 305 of one stepping block with the bottom surface 315 of another stepping block. In some embodiments, the plurality of coupling studs can be raised approximately ¼ inches above the top surface 305. To enhance the stability of the device, multiple coupling studs having at least two different sizes or configurations may be employed in the device. In some embodiments, the top surface of a stepping block may include coupling studs configured as large configurations, small inner configurations, small outer partial configurations, and small outer half-shaped configurations. For example, in the embodiment shown in FIGS. 5-10, the coupling studs are configured having large solid circles 320, large hollow circles 325, small solid partial circles 330*a*, small solid half-circles 330*b*, and small solid circles 330*c*. In the exemplary embodiment in FIG. 11, the coupling studs are configured having large solid circles 1105, small solid partial circles 1110*a*, small solid half-circles 1110*b*, and small solid circles 1110*c*. In another embodiment shown in FIG. 14, the coupling studs are configured having large solid circles 1420, small solid partial astroids 1400*a*, small solid half-astroids (deltoids) 1400*b*, and small solid astroids 1400*c*. In general, the small configurations are positioned between at least two or more large configurations in order to substantially fill in the space between the large configurations to provide a comfortable supporting surface for the user when standing or sitting. The position of the small configurations relative to the large configurations facilitates vertical and horizontal interconnections between the stepping blocks and provides stability, security and versatility for the user. The small and large configurations can be configured as any symmetrical shape, such as a circle, an astroid, a diamond, a square or a triangle such that the selected shape permits vertical and horizontal positioning of the blocks relative to each other. The small outer partial configurations and the small outer half-shaped configurations can be selected to be the same shape and size as the small inner configurations. For example, in FIG. 5, the small inner configurations 330*c* are circles; therefore, the small outer partial configurations 330*a* are selected as partial circles, and the small outer half-shaped configurations 330*b* are selected as half circles.

Figure 6:
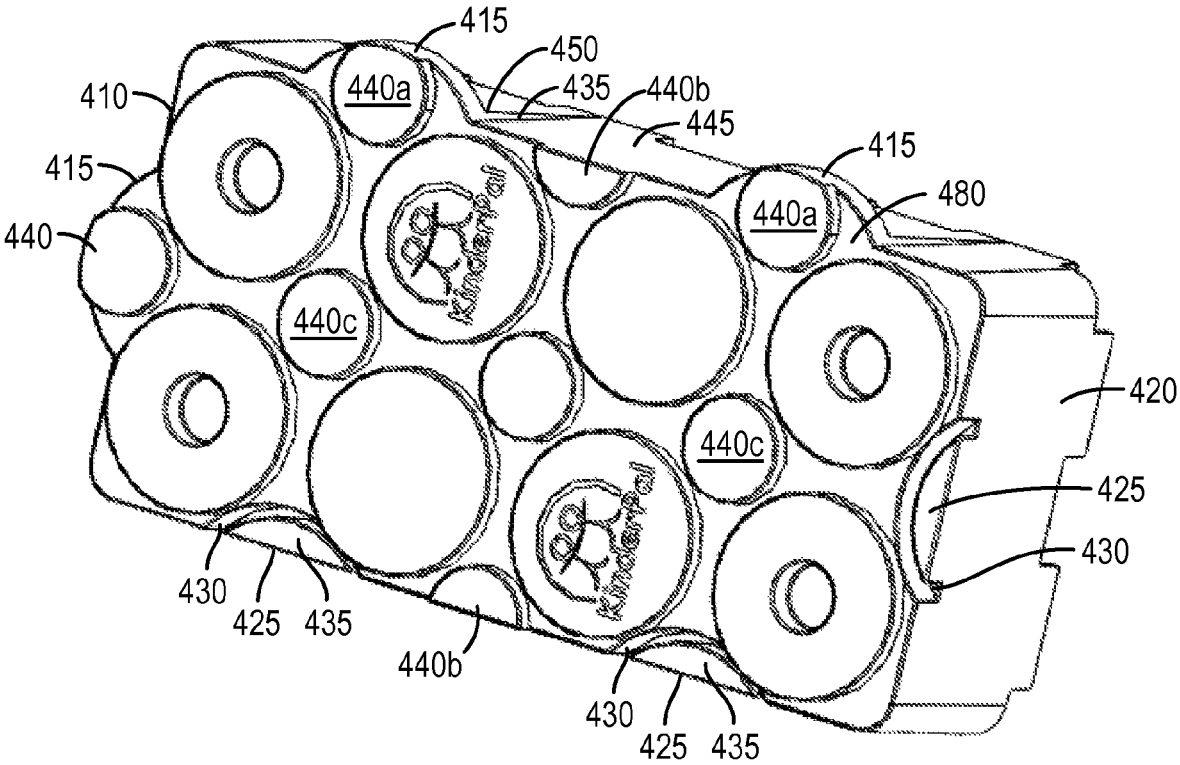
Figure 7:
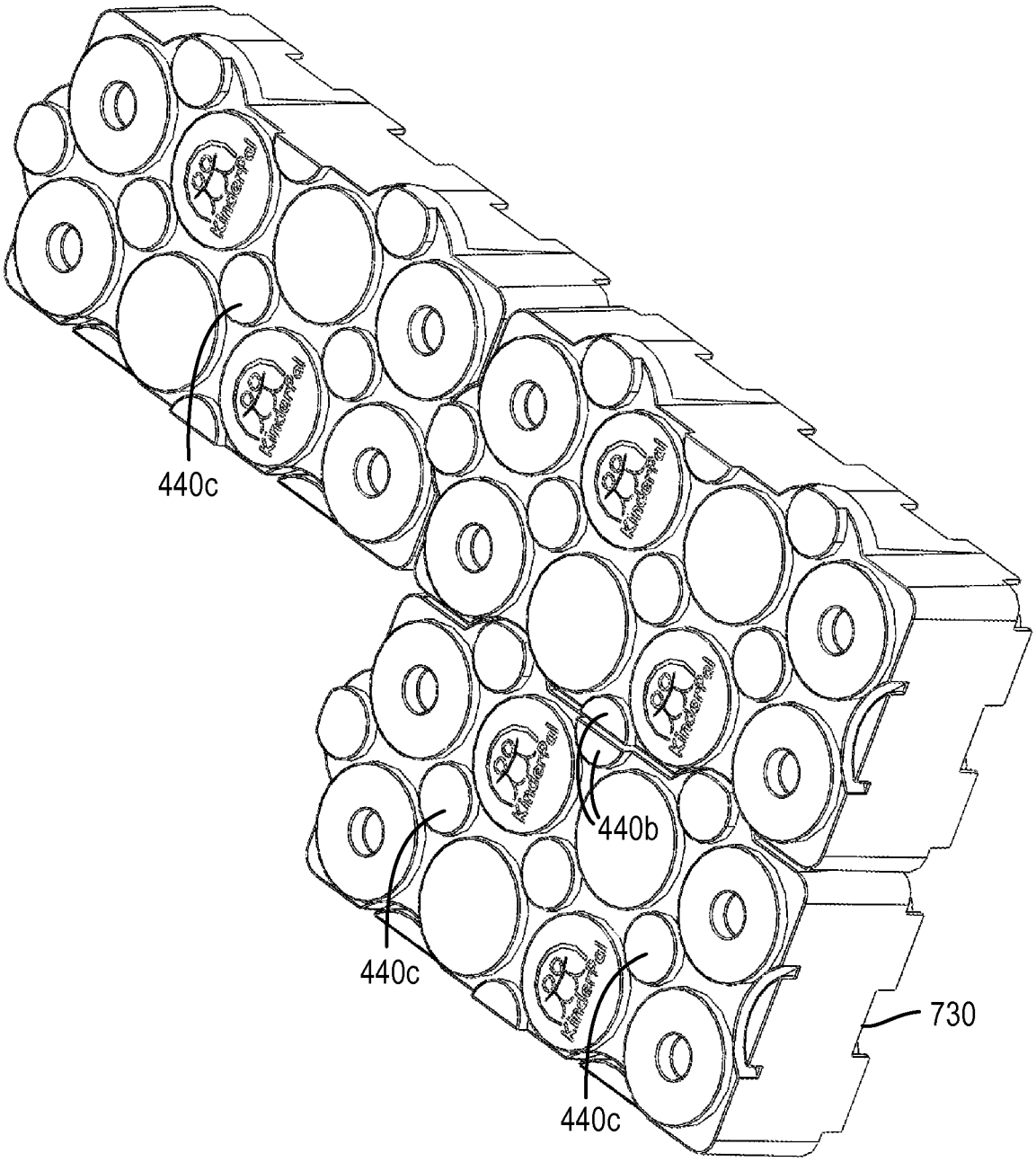
FIG. 7 is a perspective view of a plurality of the stepping blocks of FIGS. 5 and 6 interconnected in a side-by-side and front-to-back configuration.
Figure 8:
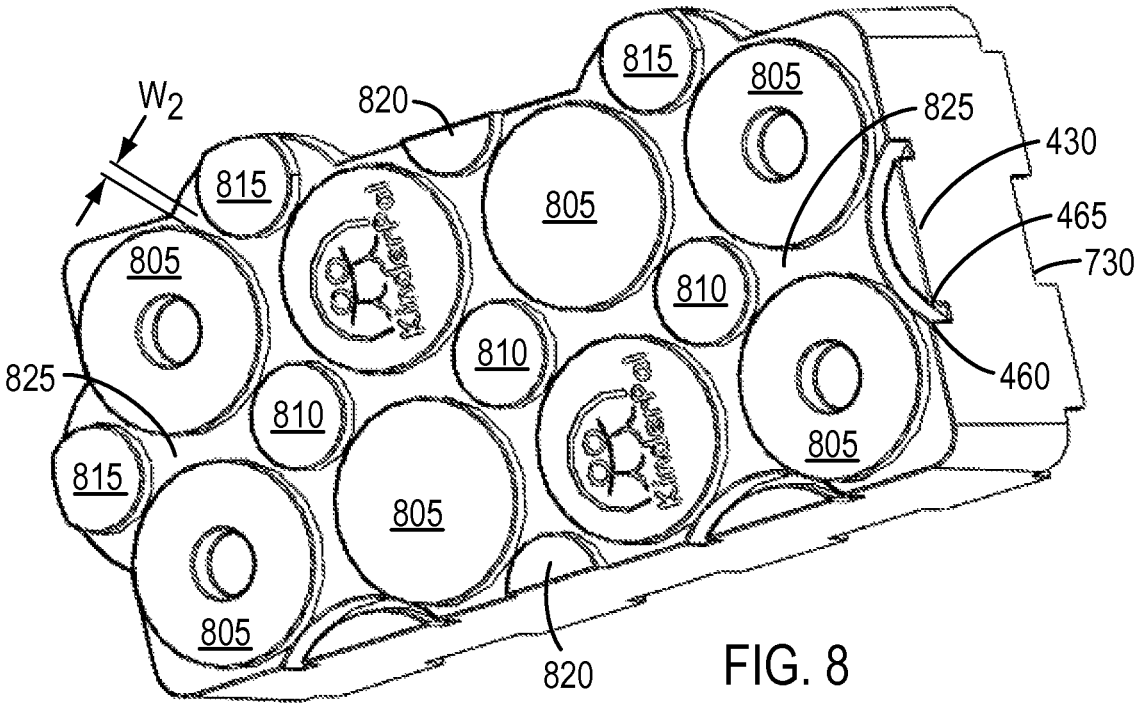
FIG. 8 is a perspective view of the stepping block of FIGS. 5 and 6.

In the example of the first embodiment shown in FIG. 6, side wall 410 includes a male connector 415 and opposing side wall 420 includes a female connector 425 such that the male connector 415 and the female connector 425 are capable of engaging each other for retaining two or more stepping blocks in a stationary relationship with respect to each other (FIG. 7). In the exemplary embodiments, the male connectors 415 are depicted as having an arc shape tongue 455 (FIG. 9) that protrudes outwardly from side wall 410 at the top surface 305. The female connectors 425 are depicted as having an arcuate groove or channel 430 formed within the top surface 305 at the side wall 420. The female and male connectors can have a variety of configurations such that the male connectors and the female connectors are of a mating size and configuration. It should be understood that the configurations of the female and male connectors shown and described in the disclosed embodiments are non-limiting and exemplary only.

As shown in FIG. 5, the depth (d) of the arcuate grooves or channels 430 are formed within the side wall 420 such that they extend downward along the side wall 420 slightly less than the midpoint of the side walls to receive the male connectors. In some embodiments (FIG. 8), a front wall 465 of the female connectors may be configured to be slightly lower than a back wall 460 of the groove or channel 430. In this embodiment, the male connectors 415 and the female connectors 425 are of a mating size and configuration such that the tongues 455 of the male connectors can slide into, engage and grip the grooves or channels 430 of the female connectors to prevent the stepping blocks from being dislodged horizontally and to resist twisting movement between horizontally attached blocks (FIG. 7). Furthermore, one or more of the male connectors 415 may include a ramp 435 (FIG. 6) that slightly inclines upward from the bottom surface towards the male connectors located at the top surface to provide additional reinforcement support for the corners 450 of the male connectors 415 to assist with supporting a user's body weight.

Some of the coupling studs may be formed as sub-coupling studs that are smaller relative to the large configurations. The sub-coupling studs may include the small inner configurations, the small outer partial configurations, and the small outer half-shaped configurations to assist with vertical alignment and stacking of the stepping blocks. Some of the coupling studs may be formed on the male connectors 415 as raised partial configurations that function as sub-coupling studs 440 to assist with the vertical alignment and stacking of the stepping blocks 300. The exemplary embodiment of FIGS. 5-10 depicts the raised configurations as raised partial small circles 440, 440*a*. Side wall 445, which is approximately twice the length of side wall 410 includes a sub-coupling stud 440*b* shaped as a half-circle positioned between two male connectors having two raised sub-coupling studs 440*a* shaped as partial circles. The sub-coupling studs 440*a*, 440*b* may be arranged at various locations along the perimeter of the top surface 305 of the stepping blocks 300. During horizontal locking as shown for example in FIG. 7, a partial circle 440*b* mates with another partial circle 440*b* to form a shape similar to the small inner configurations 440*c*. In some embodiments, horizontal locking of two or more stepping blocks having different shaped sub-coupling can be interconnected as long as the male and female connectors are capable of mating. In such an embodiment, the different shaped outer partial configurations when horizontally connected will not mate to form a shape similar to the small inner configurations.

Figure 9:
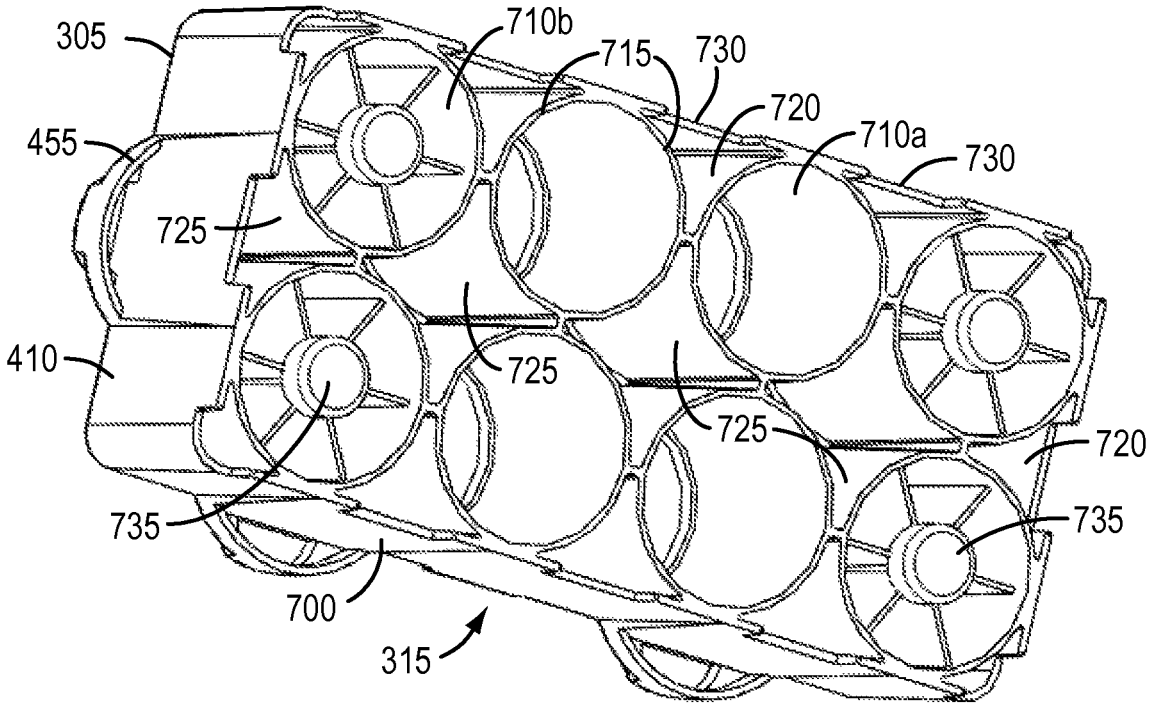
FIG. 9 is a bottom perspective view of the stepping block of FIGS. 5 and 6.

In FIGS. 9 and 10, the cavity 700 located at the bottom surface 315 can include tubular walls 710*a*, 710*b* extending from the top surface 305 such that the arcs 715 of the tubular walls 710 partitions the cavity 700 into a plurality of sub cavities that define a plurality of hypocycloids. For example, FIG. 9 depicts a plurality of hypocycloid sub cavities having a deltoid shape 720 (a hypocycloid with three cusps) and having an astroid shape 725 (a hypocycloid with four cusps). The hypocycloids are configured to receive the coupling studs 320, 325, and 330*a-c* (FIG. 5) to facilitate stacking the stepping blocks 300 in a variety of configurations. The deltoid shaped sub-cavities 720 may include a partially raised side wall 730 (FIGS. 5, 7 and 8) to receive one or more sub-coupling studs 440, 440*a*, 440*b*, and 440*c* (FIG. 6) to permit stacking of the stepping blocks in both a perpendicular direction, a longitudinal direction, and at an offset position (FIGS. 20-24) relative to each other.

In FIGS. 9 and 10, one or more tubular walls 710*b* can be configured to include a spoke-and-wheel configuration for attaching one or more projections 735. To add further stability to the device when the stepping blocks are stacked, the projections 735 can be aligned and mated with openings of the large hollow circular 325 coupling studs to define an interlocking element so that at least two of the stepping blocks 300 can be interlocked and stacked one atop of the other to form a raised step. One or more stepping blocks may include a non-skid surface to retain the modular step stool system in a fixed position relative to the floor or underlying surface. The projections 735 can also be configured having a non-skid surface to prevent shifting and slipping of the stepping block(s) located at the base level during use. Several non-skid mechanisms have been identified to secure the bottom surface of the base level to the floor; rubber skids, double-side adhesive strips, VELCRO™ and suction caps. All of these mechanisms, as well as others, can be used, as the above list is not an exclusive one. In various embodiments, rather than tubular-shaped walls 710*b*, the walls may be another configuration, such as square or triangular.

Figure 12:
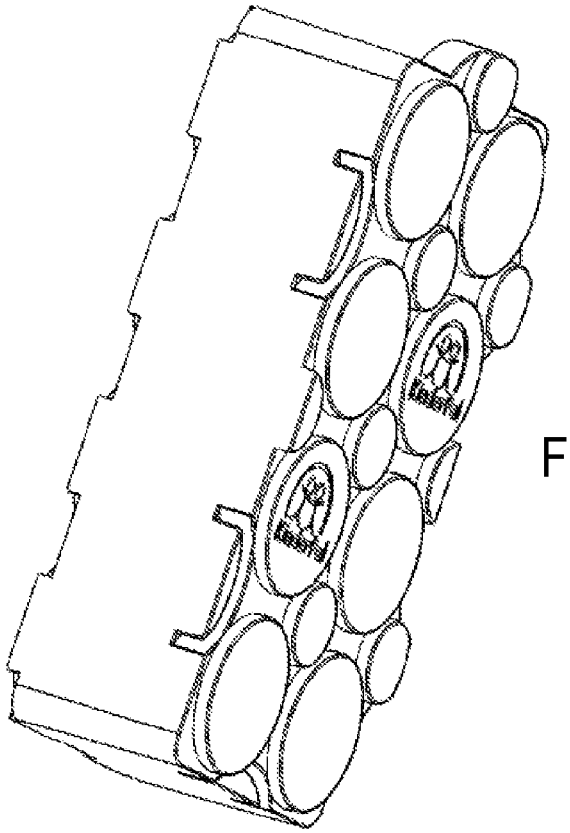
FIG. 12 is a perspective view of the stepping block of FIG. 11.
Figure 13:
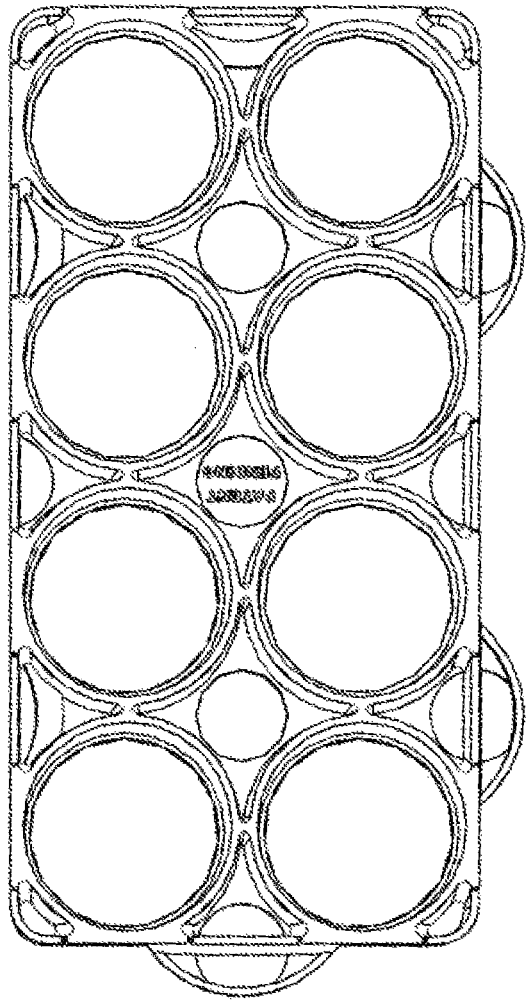
FIG. 13 is a bottom view of the stepping block of FIG. 11.

FIGS. 11-13 illustrate a second embodiment of the stepping blocks similar to the first embodiment; however, without the four large hollow circles included within the top surface and without the spoke-and-wheel configuration and the peg feet located on the bottom surface. Rather, this embodiment includes large solid circles 1105, small partial solid circles 1110*a*, small solid half-circle 1110*b*, and small solid circles 1110*c*.

In lieu of the sub-coupling studs being configured as variations of a circular-shaped, in some exemplary embodiments, other symmetrical shapes may be used as the sub-coupling studs. As illustrated in the third exemplary embodiment of FIGS. 14 and 15, the sub-coupling studs, namely, the smaller inner configurations, the small outer partial configurations, and the small outer half-shaped configurations, positioned on the top surface may be configured as variations of an asteroid shape 1400. In comparison to circular-shaped sub-coupling studs in the embodiments shown in FIGS. 3 and 11, the astroid-shaped sub-coupling studs 1400, similarly, fill-in the gaps between the large circles in order to provide a comfortable supporting surface and to facilitate vertical alignment and stacking, while making the upper surface easier to clean. In this embodiment as shown in FIG. 14, the outer edges, which are the cusps 1405 of the astroid-shaped sub-coupling studs, meet to form channels 1410 on the upper surface of the stepping blocks. FIG. 14 illustrates that the width (w1) of the asteroid-formed channels 1410 are wider than the width (w2) (FIG. 8) of the circular-formed channel 480 which are formed when the sub-couplings are circular. Thus, in this example, the width (w1) of the asteroid-formed channels 1410 provides a wider groove 1410 between the large circles than the circular-shaped sub-couplings in order to facilitate easy cleaning should the steps become soiled.

In general for all the embodiments, the upper surface may include at least one channel or ridge within the upper surface to collect any liquid that falls on the top of the upper surface to flow to the base of the upper surface. The channel or ridge permits the toddler to safely stand upon the upper surface while any spilled liquid is directed from the top of the upper surface within the channel or ridges. The channel or ridge may be configured to define an opening having an opening larger than the base of the channel or ridge to allow the liquids to easily collect or enter the channel or ridge. Likewise, the large opening enables the liquids to freely flow from the channel or ridge during cleaning of the modular step stool device 100. To clean the modular step stool device 100 and remove any liquids collected thereon, the adult caregiver may merely rinse and pour off the liquids from the upper surface and wipe off the surface.

The upper surface may comprise a plurality of individual channels or ridges. The channels or ridges may be uniform, for example, having substantially the same size, shape or other characteristic features. In lieu of a uniform configuration, at least some of the channels or ridges may have sizes, shapes or other configurations that differ from each other. In some embodiments, the channels or ridges may extend from one edge to another edge across the upper surface. In some other embodiments, the channels or ridges may be formed to outline the perimeter of the upper surface of the stepping block.

In some embodiments, other configurations may be provided at the upper surface, for example, such as a grid design. The upper surface may be made of a flexible sheet material having a screen or grid region to allow urine or other liquids to pass and collect within the base of the upper surface until individual stepping blocks or the complete modular step stool device 100 is cleaned.

Figure 15:
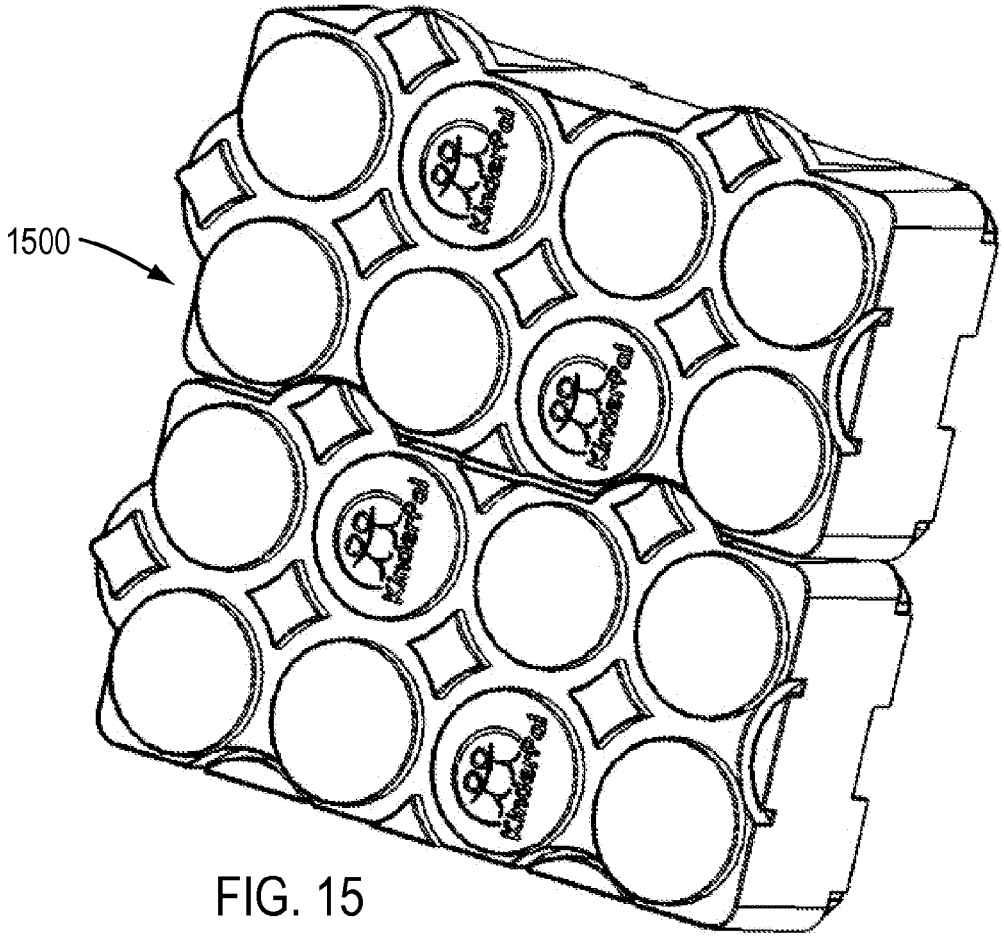
FIG. 15 is a top perspective view of a plurality of the stepping blocks of FIG. 14 interconnected in a side-by-side configuration.
Figure 16:
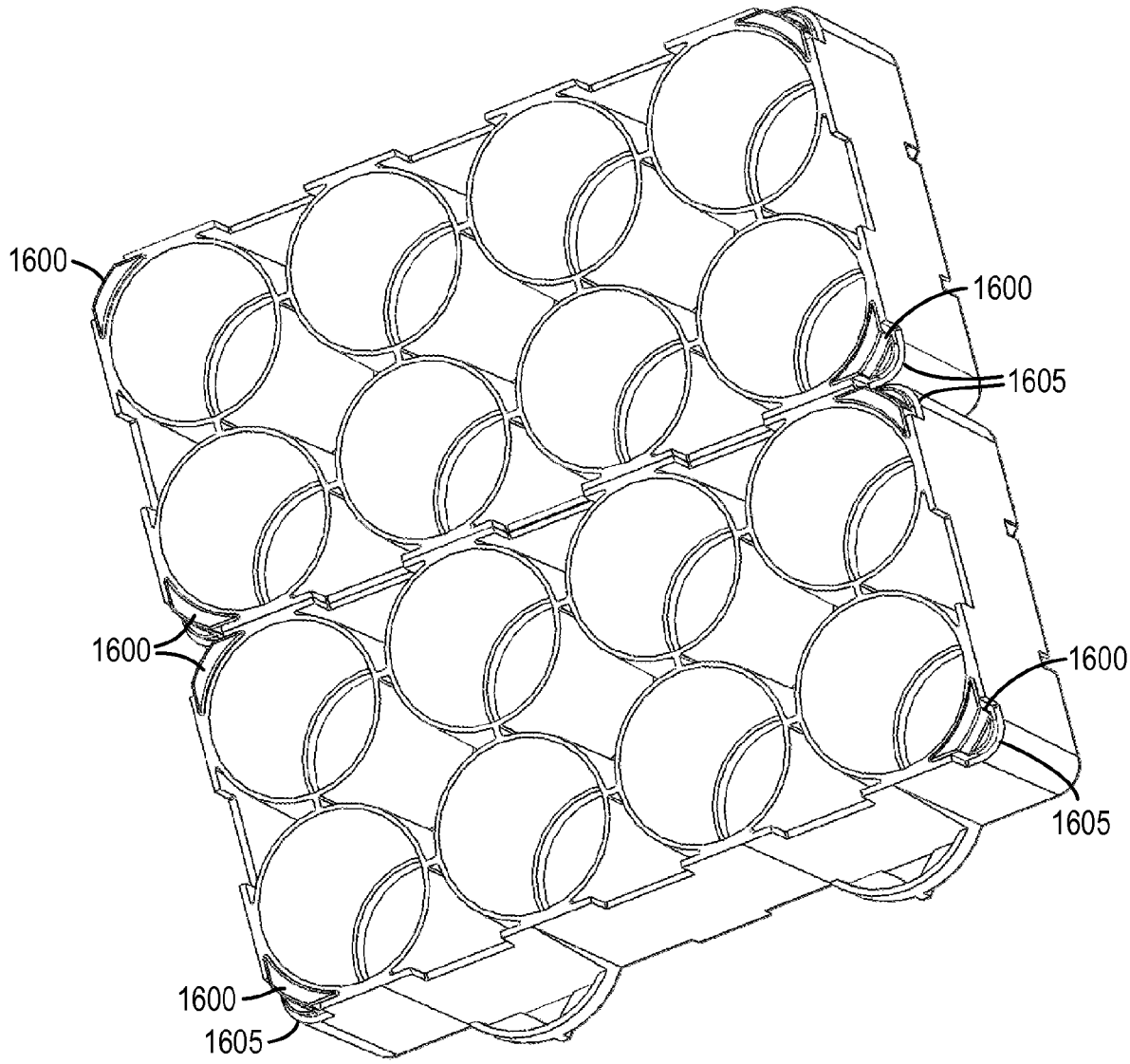
FIG. 16 is a bottom perspective view of the stepping blocks of FIG. 15 interconnected in a side-by-side configuration.
Figure 17:
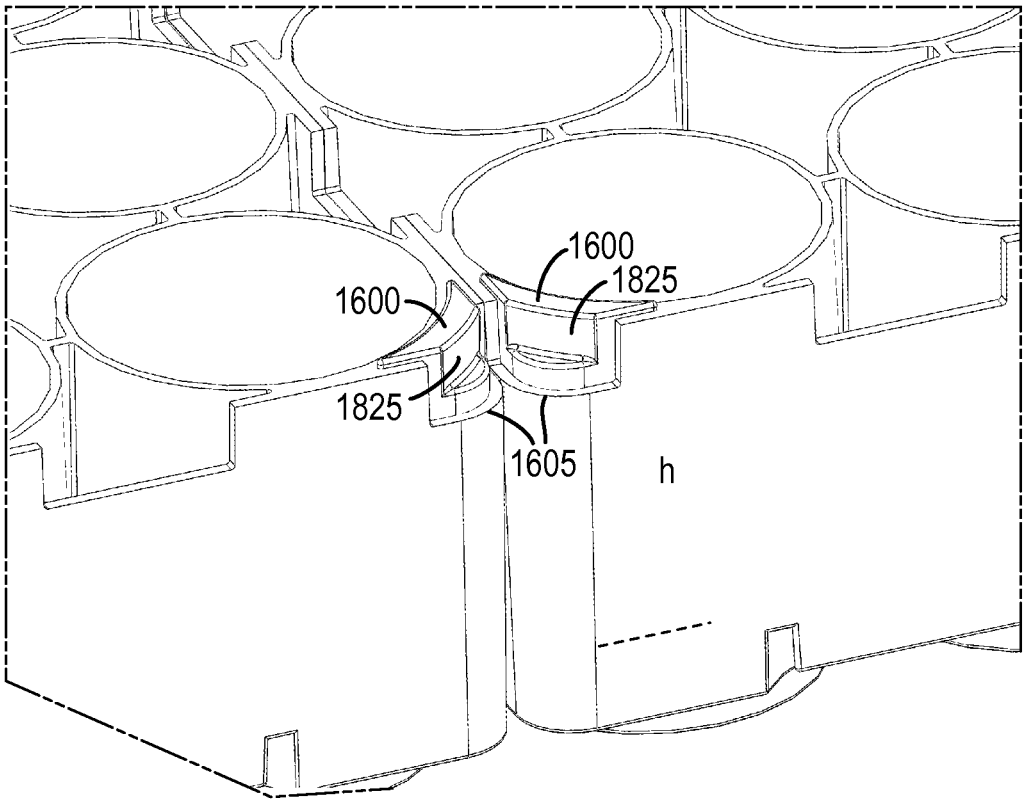
FIG. 17 is a perspective view of the stepping blocks including corner tabs inserted therein.
Figure 18:
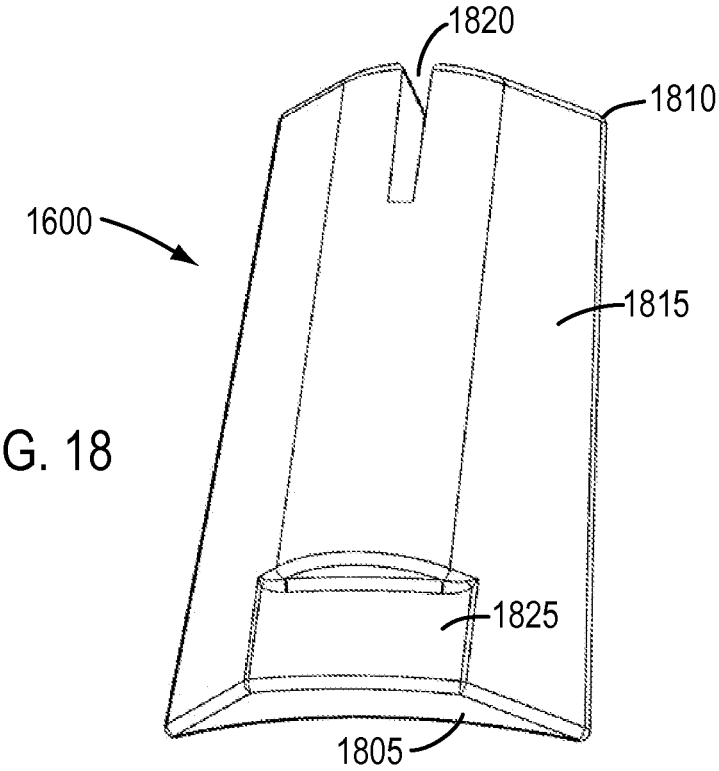
FIG. 18 is a perspective view of a corner tab according to the present teachings.

Referring back to the third embodiment, FIG. 15 illustrates a view of the stepping blocks 1500 of the third embodiment interconnected in a side-by-side manner. In comparison to the bottom surface shown in the embodiment of FIGS. 9 and 10, the spoke-and-wheel configurations having the non-skid surface projections 735 can be replaced by tabs 1600 in the embodiment in FIGS. 16 and 17 such that corner tabs 1600 are instead positioned within each corner of the bottom surface. In general, the corner tabs 1600 can have a variety of configurations (e.g., size, shape, etc.) such that they are insertable into the corners and provide a non-skid surface to prevent shifting and slipping of the stepping block(s) located at the base level during use. As depicted in FIG. 18, the corner tabs 1600 may have a solid body that tapers from its bottom surface 1805 inward towards the top surface 1810. The corner tabs 1600 may be configured so that it fits within and extends upward at least ½ the length of the opening of the corners to provide additional strength to support a user's weight. In some embodiments (FIG. 17), the height (h) of the corner tabs 1600 can be configured to be inserted within the openings of the corners to extend upward within approximately ¾ the length of the side wall of the stepping block. In FIG. 18, the corner tab 1600 may include a cut-out 1820 at the top surface and an indentation 1825 at the bottom surface. The side wall 1815 of the corner tabs 1600 may include one or more cut-outs 1820 to accommodate the geometry of any reinforcement ribs that may be constructed inside the corner such that the cut-out functions as a locking mechanism when inserted within each corner. When the corner tabs are inserted within the corners, they may be received such that they intersect perpendicularly with the reinforcement ribs to lock the corner tabs within the corners. For example in FIG. 18, the corner tabs 1600 includes cut-out 1820 that opens and extends from the top 1810 downward to accommodate a reinforcement rib (not shown) included within the corner so as to securely lock the corner tab 1600 within the corner 1605.

Figure 19:
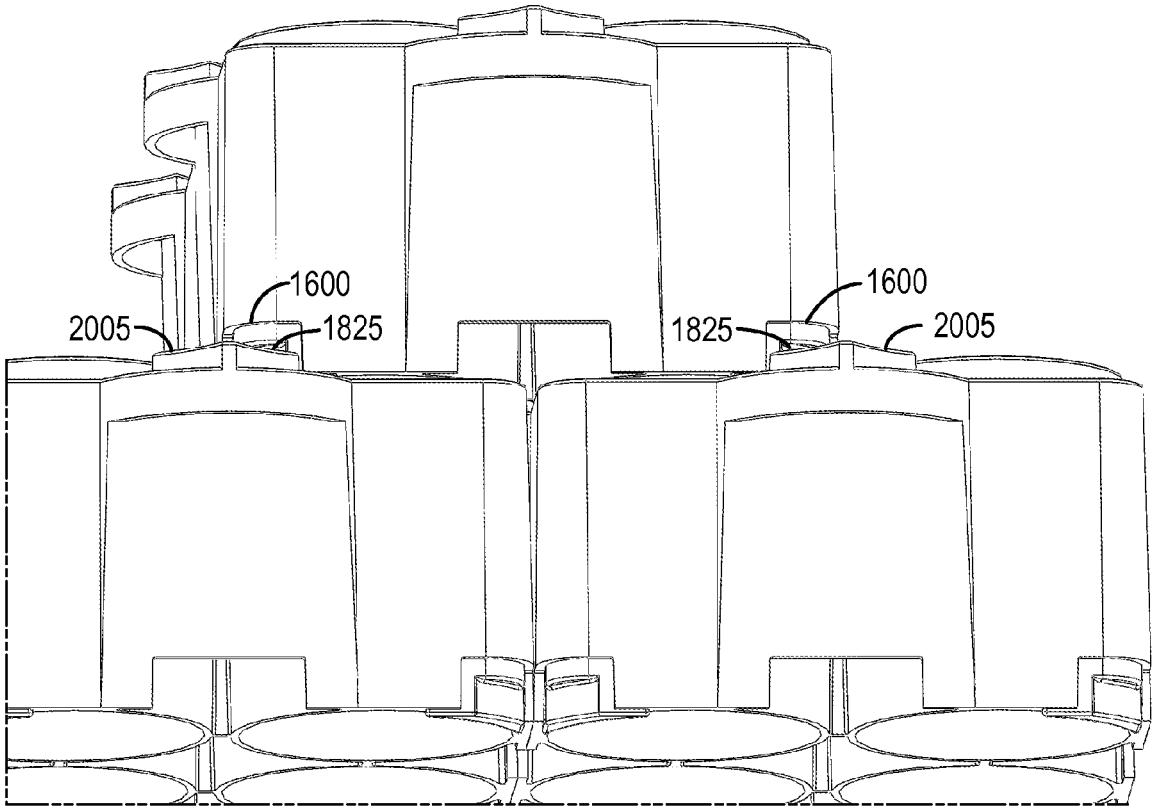
FIG. 19 illustrates stacking of a plurality of the stepping blocks with the corner tabs inserted therein.
Figure 20:
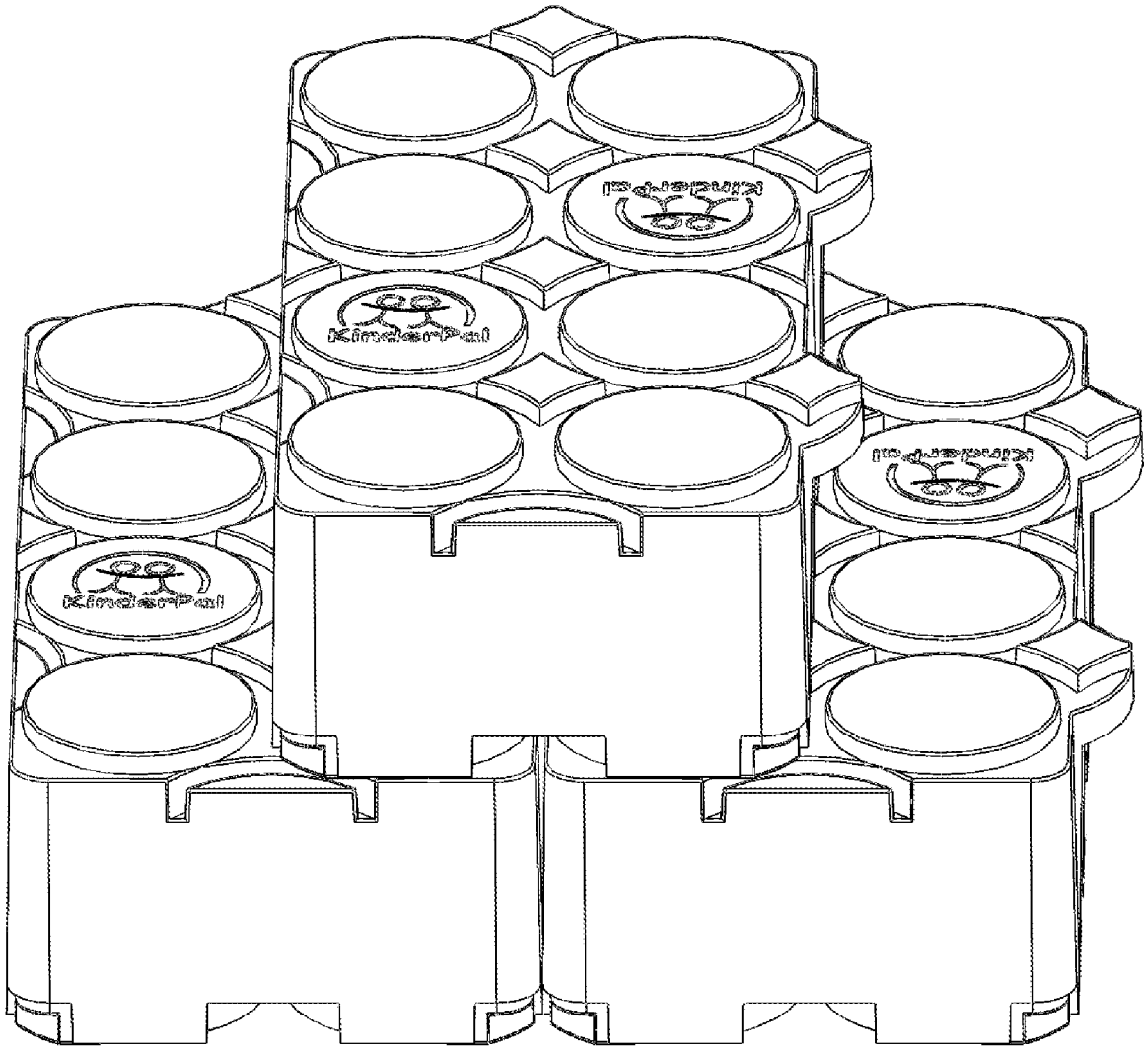
FIGS. 20 to 24 illustrate various views of stacking a plurality of stepping blocks according to the present teachings.
Figure 21:
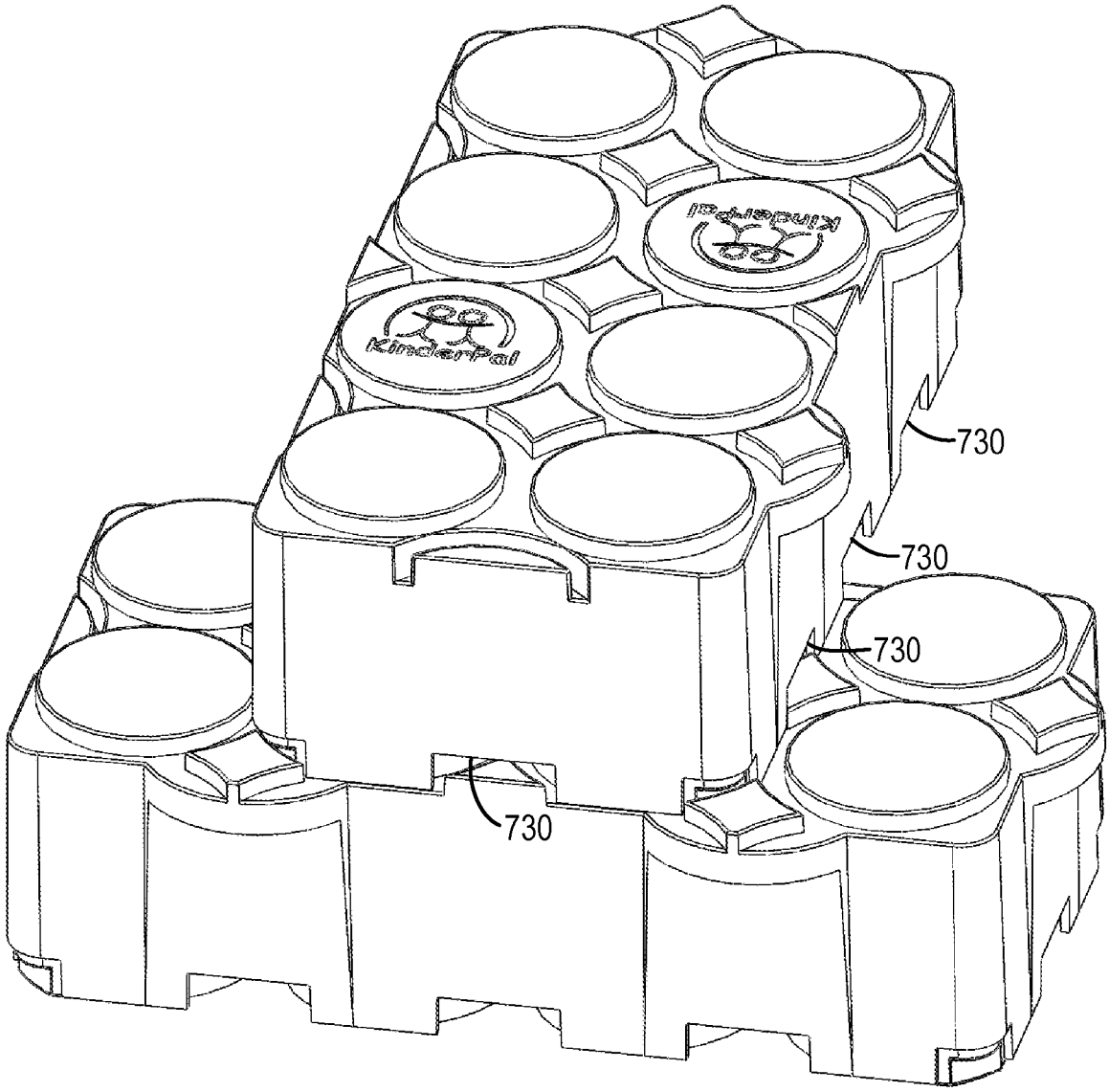
Figure 22:
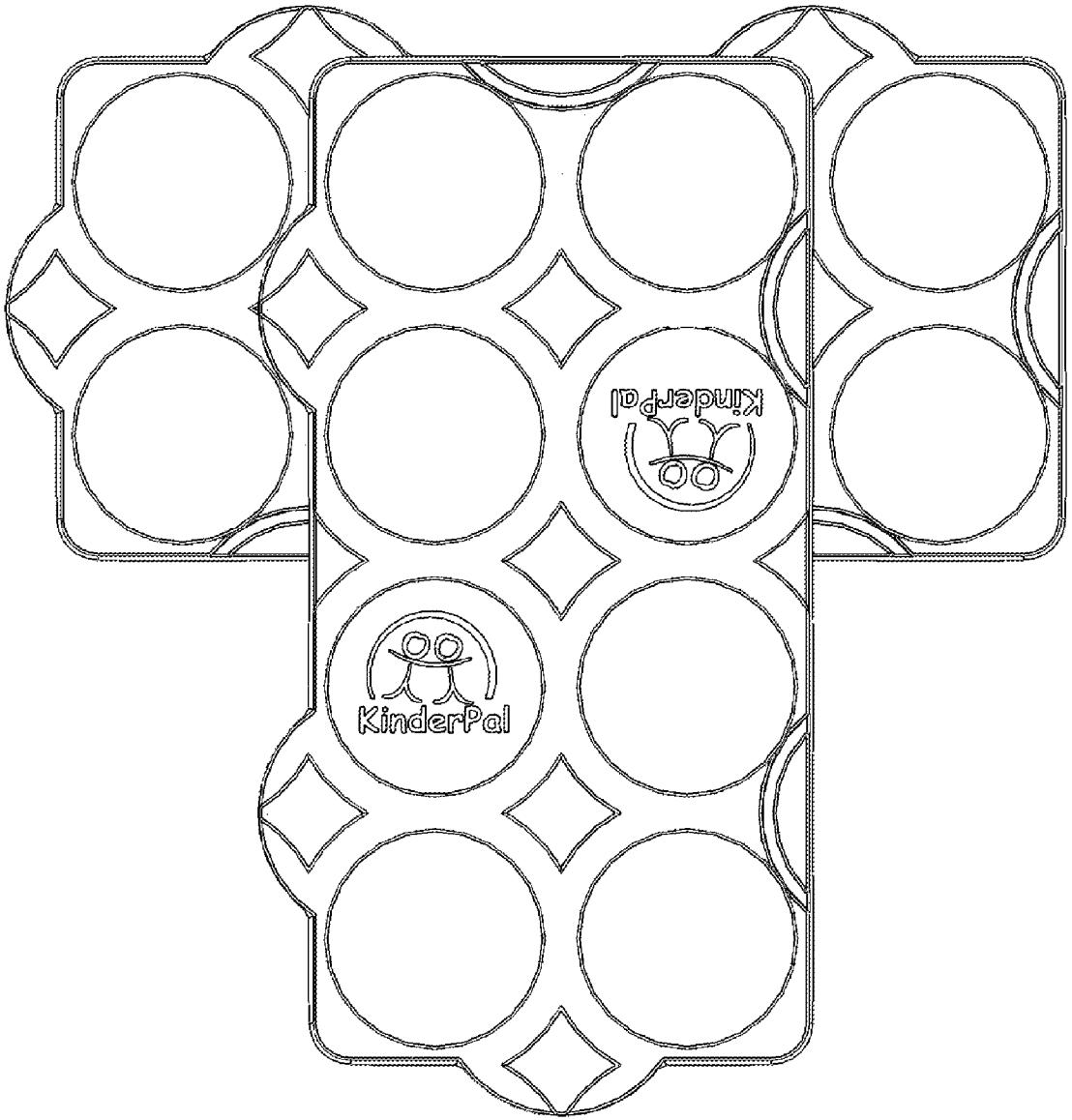
Figure 23:
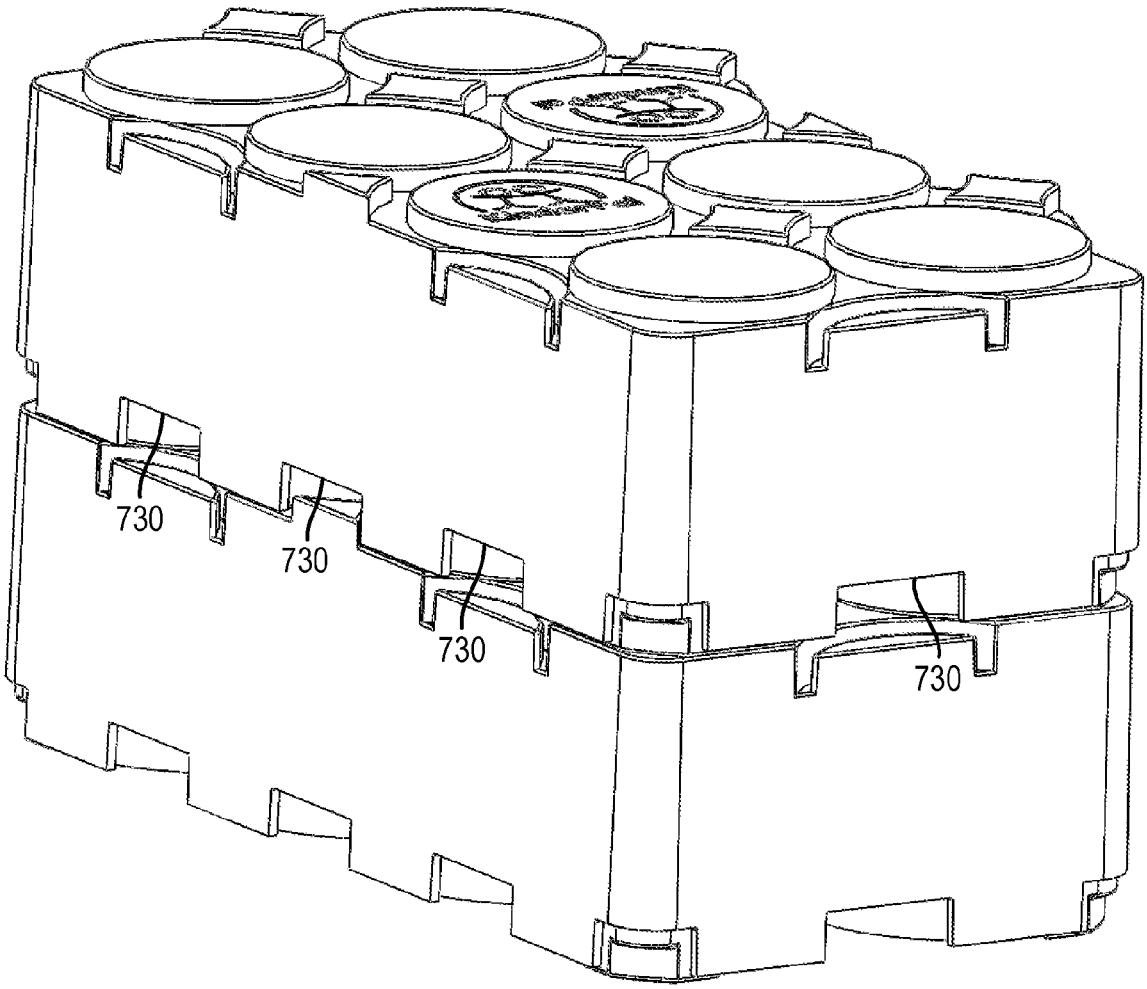
Figure 24:
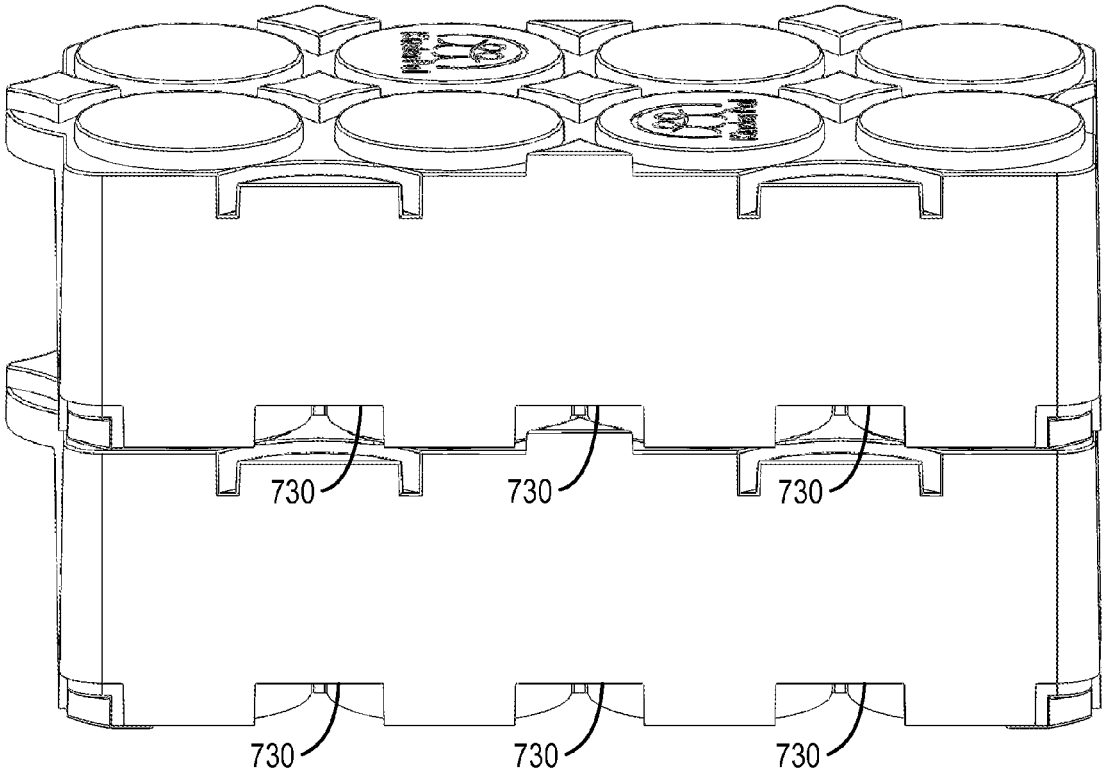

As shown in FIGS. 18, 19, and 21, indentations 1825, located at the bottom of the corner tabs 1600, can be configured based upon the specific shape of the small inner configurations to facilitate modularity of the stepping device and permit interlocking as shown, for example, in FIGS. 20-24. When the stepping blocks are stacked in an offset position (FIGS. 19-22), the indentations 1825 helps to provide clearance for the geometry of the sub-couplings, such as the small inner configurations. In other words, the indentations 1825 can be designed to be sub-coupling specific such that the configuration is selected based upon the shape of one or more sub-couplings. As shown in FIGS. 19 and 21, the indentations 1825 can be configured having a profile to conform to and mate with the shape of the sub-couplings 2005. All other features of the top surface and bottom surface of the third embodiment are similar to the above described embodiments.

FIGS. 20-24 illustrate the stepping blocks stacked and in a variety of configurations. Any of the stacked configurations depicted in FIGS. 20-24 can be employed with each embodiment described herein.

In general, the stepping blocks of the modular step stool device 100 may be made of any material or a combination of materials suitable for providing a flexible structure that is sturdy enough to support the weight of a toddler or any user during use. The stepping blocks may be made of any type of organic, inorganic, thermoplastic or thermosetting material. In some embodiments, the stepping blocks may be formed by injection molding techniques from suitable plastic compounds which cure into a flexible material. For example, the stepping blocks can be made of polypropylene, polyethylene, ABS, vinyl, nylon, rubber, ethylene vinyl acetate (EVA) foam or any other material that can be molded or injection-molded in this fashion. The stepping blocks may be reusable and inexpensive to clean and sanitize. In various embodiments, the stepping blocks may be easily cleaned by, for example, merely rinsing and wiping off the top surface or any other soiled portion of the device to remove any liquids or grime collected thereon. For example, polypropylene can provide good moisture resistance, good impact strength, and it is one of the most lightweight thermoformed materials available, inexpensive, easy to mold, provides excellent chemical resistance, and a smooth exterior finish. Another example is that polyethylene can provide good moisture resistance, good impact strength, inexpensive and easy to mold, excellent chemical resistance, and smooth exterior finish. A further example is that ABS provides extremely good impact strength, good appearance after molding, and is relatively lightweight.

Exemplary Product Features:

- Single Pad Dimensions: 6" W×12" L×3" H
- Pads are easily connectable to be configured in different shapes and sizes to fit various bathroom fixtures
- Sleek connectors provide an effortless and secure locking mechanism
- Stackable and expandable to attach with other units both vertically and horizontally to form a variety of different heights and configurations
- Easy assembly, disassembly and cleaning
- No tools, no loose connecting parts, or glue required
- Durable, sturdy, and stable
- Compact, versatile, lightweight, portable and storable
- Multiple children use
- Multipurpose device can be used as a step stool, bench, and/or kneeler The modular step stool device 100 can be assembled to have a variety of configurations. In use, the modular step stood device may be assembled for use as a step stool, platform, bench, or a kneeler to provide a safe and secure supporting surface for the toddler. In various embodiments, the modular step stool device may be converted to serve as a step stool for entry and exit during bathing (FIG. 4), as a step stool for facilitating hand washing when using a sink, such as a vanity sink (FIGS. 1 and 3), and/or as step stool for use with a urinal (FIG. 2).

It should be understood that the configurations of the modular step stool devices 100 shown and described with reference to figures herein are nonlimiting and exemplary only. The modular step stool device 100 shown in FIGS. 1, 3 and 4 are configured as steps having a rectangular configuration that align a sink or a bathtub. The modular step stool device 100 in FIG. 2 is illustrated as a platform having a substantially U-shaped profile to surround the base of a toilet. The modular step stool device 100 may be assembled to define a plurality of configurations such as, for example, a square, a rectangular, a triangular, etc. to securely conform to at least a portion of the base of a bathroom fixture. Those skilled in the art would understand that various sizes, shapes and configurations may be envisioned for the modular step stool device 100 without departing from the scope of the present teachings.

In various embodiments of the modular step stool devices in the stacked configurations (FIGS. 20-24), each stepping block can be configured to be symmetrical having substantially the same shape, thickness, and size. On the other hand, in other embodiments, the stepping blocks may be configured having different dimensions such as having different thicknesses. For example, one stepping block may be configured to serve as a base and can have a height that is twice the height of another layer of stepping blocks. Thus several layers of stepping blocks may be stacked to serve as a platform to properly adjust the toddler's height. Any combination of stepping blocks may be stacked to form, for example, a platform, a set of steps, a bench or a kneeler. The caregiver may stack as many stepping blocks, as needed, to properly adjust the toddler's height. On the other hand, as the toddler grows taller and no longer needs as many stacked levels of the stepping blocks, but the toddler still is not quite capable of fully reaching the adult bathroom fixture, the caregiver may remove any unnecessary stepping blocks to maintain the toddler's proper height with respect to bathroom fixture.

In some embodiments, the stepping blocks may be manufactured as a single component. In other embodiments, the stepping blocks may be manufactured as multiple components are assembled together during the production process.

The upper surface of each stepping block can have a variety of configurations (e.g., designs, size, shape, etc.) such that the modular step stool device provides a safe and comfortable platform for a toddler, as well as prevents the toddler from slipping from the upper surface and wherein the upper surface can be easily cleaned. In some embodiments, the upper surface may be made of an impervious material that forms a liquid barrier. Thus, the upper surface can prevent fluids from penetrating through the individual stepping blocks and reaching the underlying surface or floor.

In various embodiments, the upper surface may include an antibacterial agent and may further include an agent for eliminating odor and/or providing a pleasing fragrance. For instance, the upper surface can be treated to prevent the growth of bacterial and germs. By way of example, MICROBAN™ can be applied to the modular step stool device 100. In some embodiments, the upper surface may be impregnated with deodorizing and disinfecting materials to neutralize or reduce any odor. In lieu of the deodorizing and disinfecting materials, the upper surface may be made from an unscented flexible material. A cushioning material may be provided on the upper surface to provide additional comfort.

The modular step stool device 100 according to the present teachings may have numerous other uses in other environments including around wash basins, inside bathtubs, showers, locker rooms, and the like where a height adjustable, modular platform is needed and where bacteria, odors and moisture are involved and the protection from slippage is of a concern. In addition for use by a toddler, the modular step stool device may used by an elderly person, a disabled person or any person needing assistance in using a bathroom fixture.

In various embodiments, the modular step stool device may be convertible to another article of furniture. For example, the stepping blocks of the modular step stool device may be converted into the form of a bench, a table, a desk, a pet ramp, a chair, a storage chest, a bookcase, cubbies, a gate to close off an area or establish a perimeter, and a kid-size building structure, such as a play castle, a play fort, or a play house.

Other embodiments of the disclosure will be apparent to those skilled in the art from consideration of the specification and practice of the teachings disclosed herein. It is intended that the specification and examples be considered as exemplary only.

What is claimed is:

1. A modular step stool system comprising:

a plurality of stepping blocks;

a first stepping block having a plurality of male connectors that extends outward from a side wall at a top surface of the first stepping block, wherein at least some of the plurality of male connectors include a raised sub-coupling stud to facilitate connecting the some of the plurality of blocks together vertically;

a second stepping block having a plurality of female connectors for receiving the plurality of male connectors therein to connect the first and second stepping blocks horizontally to form a step platform and to prevent horizontal displacement of the first and second stepping blocks when connected together horizontally, wherein a surface area formed by connecting the first and second stepping blocks horizontally is configured to position and support multiple users thereon; and a ramp is provided underneath each of the plurality of male connectors and formed in the side wall, the ramp comprising a pair of spaced, opposed and upwardly extending ramp side walls, a lower edge of the ramp is located against a bottom surface of the first stepping block, an upper edge of the ramp is attached to one of the plurality of male connectors, and an inclined surface connects to each ramp side wall and extends upwardly from the lower edge to the upper edge of the ramp such that the ramp inclines upward from the bottom surface of the first stepping block towards the top surface so as to integrally connect with each of the plurality of male connectors to provide an opposing force to assist with supporting a user's body weight; corner tabs configured to be inserted into corners of the cavity at the bottom surface, wherein the corner tabs include a non-skid surface for securing the raised step platform to an underlying surface to prevent movement, the corner tabs include indentations configured having a profile based upon a shape of some of the plurality of sub-couplings to conform to and mate with the some of the plurality of sub-couplings when the first and second stepping blocks interconnect vertically in an offset position.

2. The system of claim 1, wherein each of the plurality of female connectors include a groove to slidably receive one of the plurality of male connectors, wherein an outer wall and an inner wall of the groove are configured having different heights, and wherein each of the plurality of male connectors form an arc.

3. The system of claim 1, wherein a top surface of the second stepping block includes a plurality of male connectors having the raised sub-couplings, wherein some of the raised sub-couplings of the first and second stepping blocks include small inner configurations and some of the raised sub-couplings include small outer partial configurations such that when the first and second stepping blocks connect horizontally some of the small outer partial configurations mate to form the shape of the small inner configurations.

4. A modular step stool system comprising:

a first stepping block having a plurality of male connectors that extends outward from a side wall at a top surface of a first stepping surface containing a plurality of coupling studs, wherein at least some of the plurality of coupling studs have differing configurations;

a second stepping block having a second stepping surface and a plurality of side walls extending from a top surface to define a cavity within a bottom surface, wherein the cavity is partitioned into a plurality of sub-cavities that define a plurality of hypocycloids for receiving the plurality of coupling studs to vertically interconnect the second stepping block onto the first stepping block to form a raised step platform; and a ramp is provided underneath each of the plurality of male connectors and formed in the side wall, the ramp comprising a pair of spaced, opposed and upwardly extending ramp side walls, a lower edge of the ramp is located against a bottom surface of the first stepping block, an upper edge of the ramp is attached to one of the plurality of male connectors, and an inclined surface connects to each ramp side wall and extends upwardly from the lower edge to the upper edge of the ramp such that the ramp inclines upward from the bottom surface of the first stepping block towards the top surface so as to integrally connect with each of the plurality of male connectors to provide an opposing force to assist with supporting a user's body weight; corner tabs configured to be inserted into corners of the cavity at the bottom surface, wherein the corner tabs include a non-skid surface for securing the raised step platform to an underlying surface to prevent movement, the corner tabs include indentations configured having a profile based upon a shape of some of the plurality of sub-couplings to conform to and mate with the some of the plurality of sub-couplings when the first and second stepping blocks interconnect vertically in an offset position.

5. The system of claim 4, wherein the second stepping surface of the second stepping block includes a plurality of coupling studs having differing configurations.

6. The system of claim 5, wherein the differing configurations of the plurality of coupling studs include large configurations and small configurations having a symmetrical configuration to provide modularity and permit horizontal, vertical, and perpendicular interconnections between the first and second stepping blocks.

7. The system of claim 6, further comprising channels defined between the large configurations and the small configurations to facilitate easy cleaning of the top surface of the first and second stepping blocks.

8. The system of claim 6, wherein the differing configurations of the plurality of coupling studs include a plurality of sub-couplings disposed intermediate the large configurations and wherein the plurality of the sub-couplings comprises the small configurations.

9. The system of claim 8, wherein the differing configurations of the plurality of coupling studs further include small outer partial configurations and small outer half-shaped configurations disposed along a perimeter of the first and second stepping blocks.

10. The system of claim 8, wherein a shape of the symmetrical configuration is selected from at least one of a circular shape, astroid shape, diamond shape, square shape, and a triangle shape.

11. The system of claim 4, wherein the differing configurations of the plurality of coupling studs include large configurations, small inner configurations, small outer partial configurations, and small outer half-shaped configurations to provide modularity between the first and second stepping blocks.

12. The system of claim 11, wherein at least some of the large configurations, small inner configurations, small outer partial configurations, and small outer half-shaped configurations are circular.

13. The system of claim 11, wherein at least some of the large configurations are configured as hollow circles.

14. The system of claim 11, wherein at least some of the small inner configurations, the small outer partial configurations and the small outer half-shaped configurations are astroids.

15. The system of claim 4, wherein a plurality of tubular walls extend from the top surface to form the sub-cavities of the hypocycloids.

16. The system of claim 15, wherein some of the sub-cavities of the hypocycloids define a deltoid shape.

17. The system of claim 15, wherein some of the sub-cavities of the hypocycloids define an astroid shape.

18. The system of claim 15, wherein some of the plurality of tubular walls include a spoke-and-wheel configuration having a non-skid surface projecting therefrom for securing the raised step platform to an underlying surface to prevent movement.

19. The system of claim 4, wherein the plurality of side walls include a partially raised wall located at the bottom surface of the second stepping block to receive one or more sub-coupling studs to permit stacking of the second stepping blocks onto the first stepping block in at least one of a perpendicular direction, a longitudinal direction, and an offset position.

20. A modular step stool system comprising:

a plurality of stepping blocks;

a first stepping block configured to support a user's body weight, wherein the first stepping block comprises a first stepping surface containing a plurality of coupling studs and sub-couplings, wherein the first stepping block includes a plurality of male connectors that extends outward from a side wall at a top surface of the first stepping block, wherein at least some of the plurality of male connectors include the sub-coupling stud to facilitate connecting the plurality of blocks together vertically;

a second stepping block configured to support the user's body weight;

a plurality of interlocking elements interposed between the first stepping block and the second stepping block for horizontally and vertically interconnecting and interlocking at least the first and second stepping blocks to form a raised step platform;

some of the plurality of interlocking elements including the sub-couplings configured to provide simultaneous horizontal and vertical interconnections; and a ramp is provided underneath each of the plurality of male connectors and formed in the side wall, the ramp comprising a pair of spaced, opposed and upwardly extending ramp side walls, a lower edge of the ramp is located against a bottom surface of the first stepping block, an upper edge of the ramp is attached to one of the plurality of male connectors, and an inclined surface connects to each ramp side wall and extends upwardly from the lower edge to the upper edge of the ramp such that the ramp inclines upward from the bottom surface of the first stepping block towards the top surface so as to integrally connect with each of the plurality of male connectors to provide an opposing force to assist with supporting the user's body weight; corner tabs configured to be inserted into corners of the cavity at the bottom surface, wherein the corner tabs include a non-skid surface for securing the raised step platform to an underlying surface to prevent movement, the corner tabs include indentations configured having a profile based upon a shape of some of the plurality of sub-couplings to conform to and mate with the some of the plurality of sub-couplings when the first and second stepping blocks interconnect vertically in an offset position.

21. The system of claim 20, wherein at least some of the plurality of coupling studs and the sub-couplings have differing configurations; and the second stepping block comprises a second stepping surface having a plurality of female connectors for receiving the plurality of male connectors therein to prevent horizontal displacement of the first and second stepping blocks when connected together horizontally and wherein a plurality of side walls extending from a top surface of the second stepping block to define a cavity within a bottom surface, wherein the cavity is partitioned into a plurality of sub-cavities that define a plurality of hypocycloids for receiving the plurality of coupling studs and some of the plurality of the sub-couplings to vertically interconnect the first and second stepping blocks.

22. A method of converting a modular step stool system to another article of furniture, the method comprising:

providing a plurality of stepping blocks comprising a first stepping block, a second stepping block, and a third stepping block; wherein each of the plurality of stepping blocks includes a modular construction;

interconnecting the first, the second and the third stepping blocks using a plurality of interlocking elements interposed between the plurality of stepping blocks to form a raised step platform;

horizontally interconnecting the first and second stepping blocks, wherein the first stepping block includes a plurality of male connectors and the second stepping block includes a plurality of female connectors for receiving the plurality of male connectors, wherein a surface area formed by connecting the first and second stepping blocks horizontally is configured to position and support multiple users thereon;

vertically interconnecting the third stepping blocks with the first and second stepping blocks, wherein at least one of the first and second stepping blocks include a plurality of male connectors that extend from a side wall at a top surface containing a plurality of coupling studs to facilitate connecting the plurality of blocks together vertically and wherein the third stepping block includes a plurality of side walls extending from a top surface of the third stepping block to define a cavity within a bottom surface, wherein the cavity is partitioned into a plurality of sub-cavities that define a plurality of hypocycloids for receiving the plurality of coupling studs to vertically connect with at least one of the first and second stepping blocks;

providing some of the plurality of interlocking elements including a plurality of sub-couplings configured to provide simultaneous horizontal and vertical interconnections;

providing a ramp underneath each of the plurality of male connectors and formed in the side wall of at least one of the first and second stepping blocks, the ramp comprising a pair of spaced, opposed and upwardly extending ramp side walls, a lower edge of the ramp is located against a bottom surface of at least one of the first and second stepping blocks, an upper edge of the ramp is attached to one of the plurality of male connectors, and an inclined surface connects to each rampside wall and extends upwardly from the lower edge to the upper edge of the ramp such that the ramp inclines upward from the bottom surface of at least one of the first and second stepping blocks towards the top surface so as to integrally connect with each of the plurality of male connectors to provide an opposing force to assist with supporting a user's body weight; inserting a corner tab into corners of the cavity at the bottom surface, wherein the corner tabs include a non-skid surface securing the raised step platform to an underlying surface to prevent movemer wherein the corner tabs include indentations having a profile based upon a shape of some of the plurality of sub-couplings conforming to and mating with some of the plurality of sub-couplings when the first and second stepping blocks interconnect vertically in an offset position; and converting the plurality of stepping blocks of the raised step platform to form at least one other article of furniture.

23. The method according to claim 22, further comprising the step of converting the raised step platform into the at least one other article of furniture is selected from the group consisting of a bench, a table, a desk, a pet ramp, a chair, a storage chest, a bookcase, cubbies, a gate, and a kid-size building structure.

* * * * *